US009330534B2

(12) United States Patent
Kim

(10) Patent No.: US 9,330,534 B2
(45) Date of Patent: May 3, 2016

(54) GAME APPARATUS FOR DISCHARGING FREE GIFTS

(71) Applicant: NEXCADE CO., LTD., Seoul (KR)

(72) Inventor: Yong Hwan Kim, Gyeonggi-do (KR)

(73) Assignee: NEXCADE CO., LTD., Seoul (KR)

( * ) Notice: Subject to any disclaimer, the term of this patent is extended or adjusted under 35 U.S.C. 154(b) by 0 days.

(21) Appl. No.: 14/244,862

(22) Filed: Apr. 3, 2014

(65) Prior Publication Data

US 2015/0099573 A1 Apr. 9, 2015

(30) Foreign Application Priority Data

Oct. 4, 2013 (KR) ..... 10-2013-0118339

(51) Int. Cl.
*G07F 17/32* (2006.01)

(52) U.S. Cl.
CPC ..... *G07F 17/3253* (2013.01)

(58) Field of Classification Search
USPC ..... 463/22
See application file for complete search history.

(56) References Cited

U.S. PATENT DOCUMENTS

| | | | | |
|---|---|---|---|---|
| 5,048,717 | A * | 9/1991 | Falk et al. | 221/2 |
| 5,558,340 | A * | 9/1996 | Ibe et al. | 273/448 |
| 6,139,017 | A * | 10/2000 | Kawamura | 273/445 |
| 6,209,868 | B1 * | 4/2001 | Norton | 273/118 R |
| 6,315,665 | B1 * | 11/2001 | Faith | 463/23 |
| 7,476,151 | B2 * | 1/2009 | Jaffe et al. | 463/16 |
| 2001/0000610 | A1 * | 5/2001 | Johnson | 221/13 |
| 2002/0067002 | A1 * | 6/2002 | Yoshida et al. | 273/447 |
| 2003/0064806 | A1 * | 4/2003 | Gordon et al. | 463/42 |
| 2003/0178435 | A1 * | 9/2003 | Yamaguchi | 221/2 |
| 2004/0195257 | A1 * | 10/2004 | Halliburton et al. | 221/75 |
| 2006/0094489 | A1 * | 5/2006 | Fukazawa et al. | 463/7 |
| 2006/0282323 | A1 * | 12/2006 | Walker et al. | 705/14 |
| 2007/0026916 | A1 * | 2/2007 | Juds et al. | 463/1 |
| 2008/0149658 | A1 * | 6/2008 | Hudis et al. | 221/2 |
| 2008/0318671 | A1 * | 12/2008 | Rowe et al. | 463/26 |
| 2009/0036199 | A1 * | 2/2009 | Myus et al. | 463/23 |
| 2009/0191931 | A1 * | 7/2009 | Peck | 463/7 |
| 2011/0272887 | A1 * | 11/2011 | McGrath | 273/448 |
| 2014/0045565 | A1 * | 2/2014 | Lim et al. | 463/7 |

FOREIGN PATENT DOCUMENTS

| | | | | |
|---|---|---|---|---|
| JP | 2001344643 | A * | 12/2001 | |
| JP | 2005323773 | A * | 11/2005 | A63F 9/00 |
| KR | 20-2010-0009016 | U | 9/2010 | |

* cited by examiner

*Primary Examiner* — Tramar Harper
(74) *Attorney, Agent, or Firm* — The PL Law Group, PLLC

(57) ABSTRACT

Provided is a game apparatus for discharging free gifts. The game apparatus for discharging the free gifts, including: a betting button unit that sets betting sums of money; a gift showcase that includes two or more betting zones according to the betting sums of money, the betting zones in which the free gifts are displayed; lamps that enable the two or more betting zones to be distinguished from each other; an extruder that is driven to be moved forward or backward, in a direction (Z) in which the free gifts are displayed, within a plane located at an outer side of the gift showcase; and a control unit that controls the extruder to be moved to a betting zone corresponding to a betting sum of money set through the betting button unit.

8 Claims, 16 Drawing Sheets

PRIOR ART

GAME APPARATUS FOR DISCHARGING FREE GIFTS

CROSS REFERENCE TO RELATED APPLICATIONS

This application claims the benefit of Korean Patent Application No. 10-2013-0118339, filed on Oct. 4, 2013, entitled "Game apparatus for discharging free gifts", which is hereby incorporated by reference in its entirety into this application.

BACKGROUND

1. Field of the Invention

The present invention relates to a game apparatus for discharging free gifts.

2. Description of the Related Art

Generally, a game apparatus having a gift dispenser designed to augment a sense of fulfillment or entertainment, in addition to the purpose of playing a game through an electronic game apparatus, has recently become popular, and heavy investment has been made in the development of the gift dispenser.

FIG. 1 illustrates a conventional gift game apparatus that is disclosed in Korean Utility Model Application Publication No. 20-2010-0009016 (entitled "Vending Machine for Game having Laser Shooting Diameter").

Referring to FIG. 1, in the vending machine for games having: a main body 3 that has a display stand 2 for displaying free gifts fixed in the inside thereof; a door 7 that is openably and closably fixed to the main body 3 and has a paper money inlet 4 and buttons 5, 6 for horizontal and vertical movements; a moving member that is embedded in the main body 3, is moved in an upward/downward direction along left and right vertical belts linked with driving of a first drive motor, and is moved in a leftward/rightward direction along a horizontal belt linked with driving of a second drive motor; and a rod-shaped pusher 16 that is mounted to the moving member 14 and is moved in a forward/backward direction by a rack gear 15 synchronized and linked with a pinion gear fixed on an axis of a third drive motor (not drawn) upon driving the third drive motor (not drawn) to drop the relevant free gift from the display stand to a discharging outlet 17, the vending machine includes: a long hole-shaped through hole 19 for the free gift that is installed at the front of the display stand 2, and is selectively passed through by the pusher 16 moved in an X-axis direction and a Y-axis direction by operation of the buttons 5, 6; a gift plate that has a circular shaped-through hole 20 for the free gift having a size corresponding to a pressing part 18 of the pusher 16 and is made of a transparent material (an acrylic material and the like); a laser sight 22 that is mounted on the moving member 14, discharges laser beams when the buttons 5, 6 are operated, and is able to obtain a position movement value (which denotes a moving distance of the X-axis direction and Y-axis direction) of the pusher 16 capable of passing through the through holes 19, 20 for the free gift by the laser beams discharged to the free gift of the display stand 2 when the moving member 14 is moved in horizontal or vertical directions upon the driving of the first and second drive motors according to the operation of the buttons 5, 6.

The circular shaped-through hole 20 for the free gift formed on the gift plate is arranged in at least one row in a horizontal direction (the drawing shows that the circular shaped-through holes 20 for the free gift is formed in two and three rows). The circular-shaped through hole 20 for the free gift is arranged in the gift plate in at least one row in the vertical direction even though it is not illustrated.

In the conventional game apparatus, the pusher 16 must be accurately moved in the direction of the X-axis and/or Y-axis in order to hit the free gift using the buttons, and accordingly, it reduces the chances of winning the game, and in order to obtain a high-priced free gift with the same betting sum of money, the free gift must pass through narrower through holes 19 and 20.

Also, the conventional game apparatus does not enable a gamer to obtain a desired gift because all of the free gifts are set to the same betting sum of money. That is, it is impossible for the gamer to select and play a game in a state of different free gifts being provided according to different betting sums of money.

In other game apparatuses, a game for moving the pusher forward and backward to hit a desired free gift so that the free gift is dropped to the gift discharging outlet, even by a small impact, thereby being causing the game to be vulnerable to minor external impact.

Moreover, when a person shakes the frame of the game apparatus intentionally or applies an impact to the frame, free gifts fall and are discharged.

That is, referring to FIG. 2 illustrating one example of a gift discharge control state according to the conventional art, the game apparatus is configured such that a movable gift discharge blocking part 60 blocks passage of the discharged free gift (at position x) when a free gift falls into a gift falling portion 50, and the gift discharge blocking part 60 may move (to a y position) so that the dropped free gift is discharged to a discharge unit 40 when an extruder is operated.

The game apparatus is configured such that the gift discharge blocking part 60 blocks the discharge of the free gift in the x position so that the free gift is kept at a lower portion of the frame 21 even if free gift might be dropped during game playing by shaking the frame, and the gift discharge blocking part 60 is moved to the y position when the extruder is operated, thereby enabling the free gift to be discharged to the discharge unit 14.

However, in this case, since the free gift may also fall to the discharge unit when an external impact is applied to the frame of the game apparatus while playing and before the game is finished, in order to prevent this, the gift discharge blocking part after the finishing of the game is operated, and accordingly, this causes an inconvenience wherein the gamer needs to wait a predetermined time after the end of the game in order to discharge the free gift.

SUMMARY

Accordingly, the present invention has been made keeping in mind the above problems occurring in the related art, and a first aspect of the present invention is to provide a game apparatus for discharging free gifts in which different free gifts are arranged according to betting sums of money.

Also, a second aspect of the present invention is to provide a game apparatus for discharging free gifts in which at least two betting zones distinguished by different betting sums of money are installed.

Also, a third aspect of the present invention is to provide a game apparatus for discharging free gifts which is configured such that betting zones are arranged in rows or layers, or are composed of two or more layers or two or more rows.

Also, a fourth aspect of the present invention is to provide a game apparatus for discharging free gifts in which a gift receiving unit is installed so that a relevant free gift can be discharged through a discharge unit only when a game is normally finished.

Also, a fifth aspect of the present invention is to provide a game apparatus for discharging free gifts which has a gift receiving unit configured to change a discharging direction of the free gifts received in the gift receiving unit according to whether or not vibration of a frame is detected.

Also, a sixth aspect of the present invention is to provide a game apparatus for discharging free gifts which enables a gift receiving unit to be controlled in a standby state, a receiving state, an ending state.

Also, a seventh aspect of the present invention is to provide a game apparatus for discharging free gifts which enables a gamer to drop the free gifts more interestingly by varying hitting points for the free gifts rather than providing a simple pusher game.

Also, an eighth aspect of the present invention is to provide a game apparatus for discharging free gifts in which lamps are mounted so that betting zones can be easily distinguished from each other.

In order to achieve the first and second aspects, provided is a game apparatus for discharging free gifts, which is configured such that a free gift is discharged through a discharge unit according to a result of playing a game, the apparatus including: a betting button unit that sets betting sums of money; a gift showcase that is comprised of two or more betting zones distinguished by the betting sums of money, the betting zones in which the free gifts are displayed; an extruder that is driven to be moved forward or backward, in a direction Z in which the free gifts are displayed, within a plane located at an outer side of the gift showcase; and a control unit that controls the extruder to be moved to a betting zone corresponding to a betting sum of money set by the betting button unit.

Also, in one embodiment, the game apparatus for discharging free gifts may further include a key operating unit having movement keys for moving the extruder in a leftward/rightward (X) direction or an upward/downward (Y) direction, wherein the control unit may enable the extruder to be moved to the corresponding betting zone in the leftward/rightward direction (X) or the upward/downward (Y) direction, according to the operation of the movement key for the leftward/rightward (X) direction or the upward/downward direction (Y), after the extruder has been moved to the betting zone corresponding to the betting sum of money.

In order to achieve the above third aspect, the betting zones may be arranged in layers, the control unit may be configured so that the extruder is moved to a layer of the gift showcase corresponding to the betting sum of money set by the betting button unit, and the control unit may be also configured so that the extruder is moved to the corresponding layer in the leftward/rightward (X) direction, according to the operation of the movement key for the leftward/rightward (X) direction of the key operating unit, after the extruder has been moved to the row of the gift showcase corresponding to the betting sum of money.

Also, in order to achieve the above third aspect, the betting zones may be arranged in rows, the control unit may be configured so that the extruder is moved to a row of the gift showcase corresponding to the betting sum of money set by the betting button unit, and the control unit may be also configured so that the extruder is moved to the corresponding row in the upward/downward (Y) direction, according to the operation of the movement key for the upward/downward (Y) direction of the key operating unit, after the extruder has been moved to the layer of the gift showcase corresponding to the betting sum of money.

Also, in order to achieve the above third aspect, the betting zones may be comprised of two or more layers, or two or more rows, and may be configured so that the free gifts are displayed horizontally or vertically, and the control unit may be configured so that the extruder is moved to a corresponding section in the upward/downward (Y) direction or the leftward/rightward (X) direction by operating the movement key for the leftward/rightward (X) direction or the upward/downward direction (Y) of the key operating unit after the extruder has been moved to the betting zone corresponding to the betting sum of money.

Also, in order to achieve the fourth aspect, the game apparatus may include: a discharge unit that discharges the free gift obtained from the gift showcase; a storage unit that keeps the free gift dropped from the gift showcase; a gift receiving unit that is rotated to enable the received free gift to turn to the discharge unit or the storage unit; a vibration detecting sensor that detects vibration of the game apparatus; and a control unit that controls a rotation direction of the gift receiving unit during a game, according to the detection of the vibration, wherein the control unit is configured such that the gift receiving unit is rotated in a state of free gifts being received therein during the game, and is rotated to enable a discharge direction of the free gift received in the gift receiving unit to turn to the discharge unit when the vibration is not detected by the vibration detecting sensor, or is rotated to enable the discharge direction of the free gift to turn to the storage unit when the vibration is detected.

The gift receiving unit may be in a standby state in which the free gift is controlled to turn to the storage unit, a receiving state in which the free gift is controlled to be received during the game, and an ending state in which the received free gift is controlled to turn the discharge unit or the storage unit, wherein the control unit controls the gift receiving unit in the standby state before starting of the game, and controls the gift receiving unit in the receiving state during the game, and controls the gift receiving unit in the ending state when finishing the game.

Also, in order to achieve the above sixth aspect, the game apparatus for discharging free gifts may further include: a gift input detecting sensor that detects whether or not the free gift is input in the gift receiving unit, wherein the control unit controls a rotation direction of the gift receiving unit according to whether or not vibration is detected by the vibration detecting sensor when the free gift is judged to be input in the gift receiving unit through the gift input detecting sensor.

Also, the control unit may enable the gift receiving unit to be rotated so as to be in a state of receiving the free gift, and may control a discharge direction of the free gift received in the gift receiving unit to turn to the discharge unit when the free gift is judged to be input in the gift receiving unit through the gift input detecting sensor and the vibration is not detected by the vibration detecting sensor.

Also, in order to achieve the above seventh aspect, a gift movement prevention device is provided for preventing a free gift hit by the extruder at the gift showcase from being moved in a next step.

At this time, the gift movement prevention device may be comprised of a gift movement prevention projection which protrudes in a predetermined height from a bottom surface on which the free gift is displayed, or a connecting rod having a predetermined thickness for connecting a bottom surface and a ceiling surface each on which the free gift is displayed.

In one embodiment, provided is a game apparatus for discharging free gifts in order to achieve the seventh embodiment, which is configured such that a free gift is discharged to a discharge unit according to a result of playing a game, the game apparatus including: a betting button unit that sets betting sums of money; a gift showcase that is comprised of two or more betting zones according to the betting sums of money, the betting zones in which free gifts are displayed; lamps that enable the two or more betting zones to be distinguished from each other; an extruder that is driven to be moved forward or backward, in a direction Z in which the free gifts are displayed, within a plane located at an outer side of the gift showcase; and a control unit that controls the lamps of a betting zone corresponding to a betting sum of money set by the betting button unit to be turned off, and controls the extruder to be moved to the corresponding betting zone.

At this time, the betting zones may be arranged in layers and may have the lamps distinguished by each layer, the betting zones may be arranged in rows and may have the lamps divided according to each row, or the betting zones may be comprised of two or more layers, or two or more rows, and may be configured such that the lamps are positioned at an edge of the betting zone, and the control unit may control the lamps corresponding to the betting zone of the gift showcase corresponding to the betting sum of money set by the betting button unit to be turned off.

According to one embodiment of the game apparatus for discharging free gifts of the present invention, since different free gifts for each betting sum of money are arranged, a gamer can enjoy a game by selecting various gifts according to the betting sums of money.

Also, according to another embodiment of the game apparatus for discharging free gifts, a gamer can enjoy games in betting zones distinguished by different betting sums of money.

Also, in yet another embodiment of the game apparatus for discharging free gifts, since the betting zones may be variously configured such that the betting zones are arranged in rows or layers, or the betting zones are comprised of two or more layers, or two or more rows, it is advantageous in that various types of game apparatuses may be configured according to gamer request.

Also, in still yet another embodiment of the game apparatus for discharging free gifts of the present invention, the free gift is discharged through the discharge unit only when it is normally hit by the extruder as a result of playing a game, and accordingly, it is advantageous in that the free gift can be prevented from being discharged illegally.

Also, in one embodiment of the game apparatus of the present invention for discharging free gifts, a discharging direction of the free gift received in the gift receiving unit may be controlled according to whether or not vibration of the frame is detected, and accordingly, it is advantageous in that the free gift can be reserved so as not to be discharged when forcible external pressure or impact is detected.

Also, in another embodiment of the game apparatus for discharging free gifts of the present invention, the gift receiving unit may be controlled to be in a standby state, receiving state, and ending state, and accordingly, it is advantageous in that the free gift received in the gift receiving unit can be discharged only when the free gift is received through a normal game because the operation states of the gift receiving unit are divided and controlled according to each step.

Also, in yet another embodiment of the game apparatus for discharging free gifts of the present invention, since games can be played by the varying of hitting points according to each form in which free gifts are disposed, a gamer can enjoy more interesting game play.

Furthermore, in yet still another embodiment of the game apparatus for discharging free gifts of the present invention, since the lamps are mounted so that the betting zones can be easily distinguished from each other, it is advantageous in that a gamer can easily distinguish between betting zones selected by the player from other betting zones because the lamps are turned off according to betting sums of money by the gamer.

BRIEF DESCRIPTION OF THE DRAWINGS

The above and other embodiments, features and other advantages of the present invention will be more clearly understood from the following detailed description when taken in conjunction with the accompanying drawings, in which.

DETAILED DESCRIPTION

Hereinafter, the terms or words used in the specification and claims are not to be interpreted by their typical or dictionary meanings, but their meanings and concepts should be construed in conformity with the technical idea of the invention, based on the principle that the inventor can properly define the concepts of the terms so as to explain the invention in the best manner.

Throughout the specification, when a certain portion "includes" a certain component, this indicates that the other components are not excluded, and may be further included unless otherwise noted. The terms "unit," "-or/er," "module," "device," and the like described in the specification indicate a unit for processing at least one function or operation, which may be implemented by hardware, software, or a combination thereof.

Exemplary embodiments of the present invention will be described in detail below with reference to the accompanying drawings.

Figure 1:
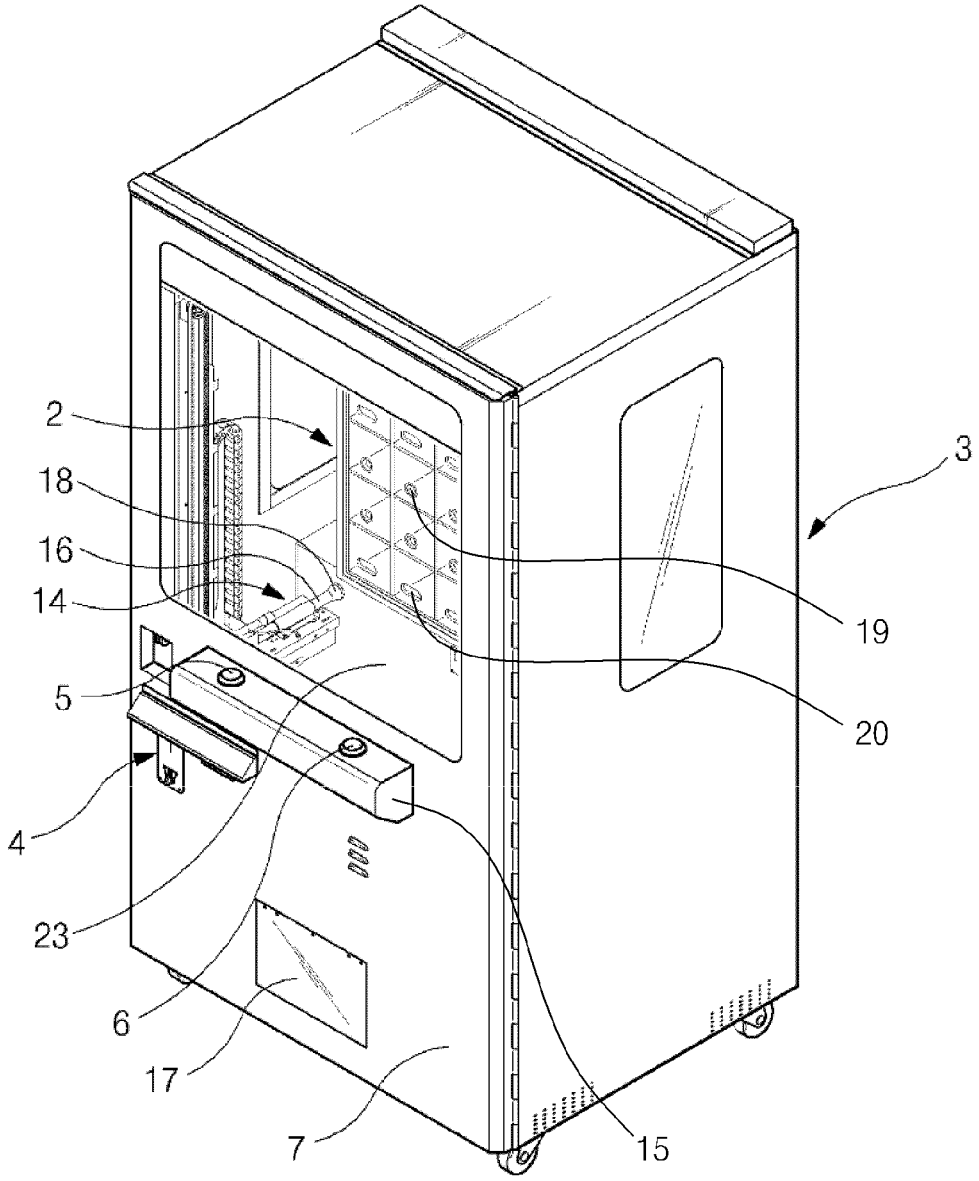
FIG. 1 is a perspective view illustrating a conventional gift discharging operation device.
Figure 2:
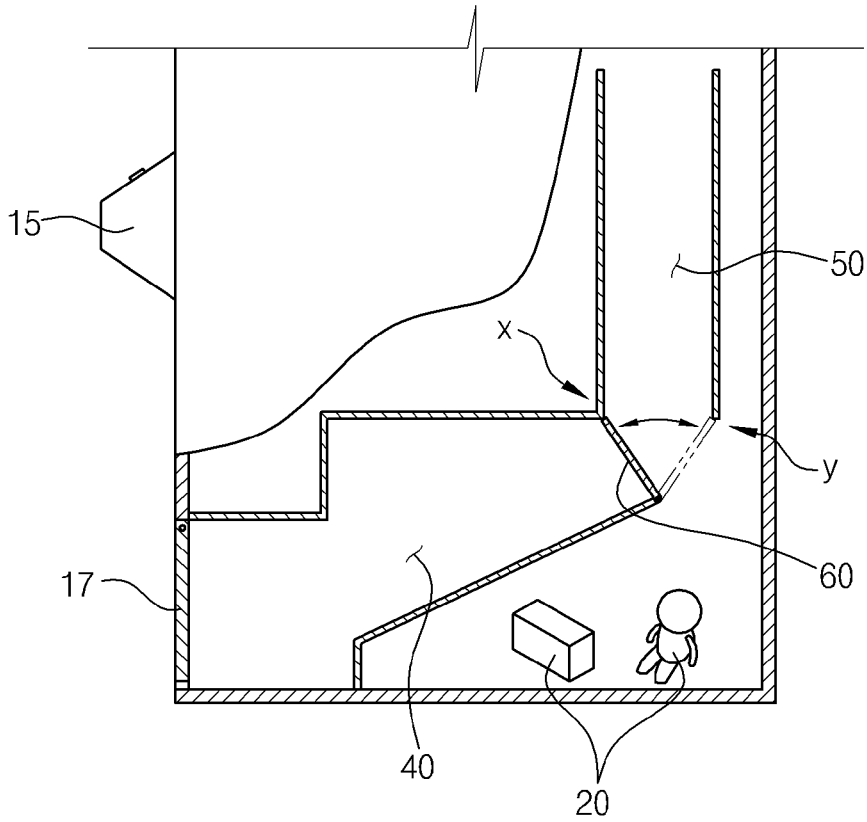
FIG. 2 is an illustration of one example of a gift discharge control state according to related art.
Figure 3:
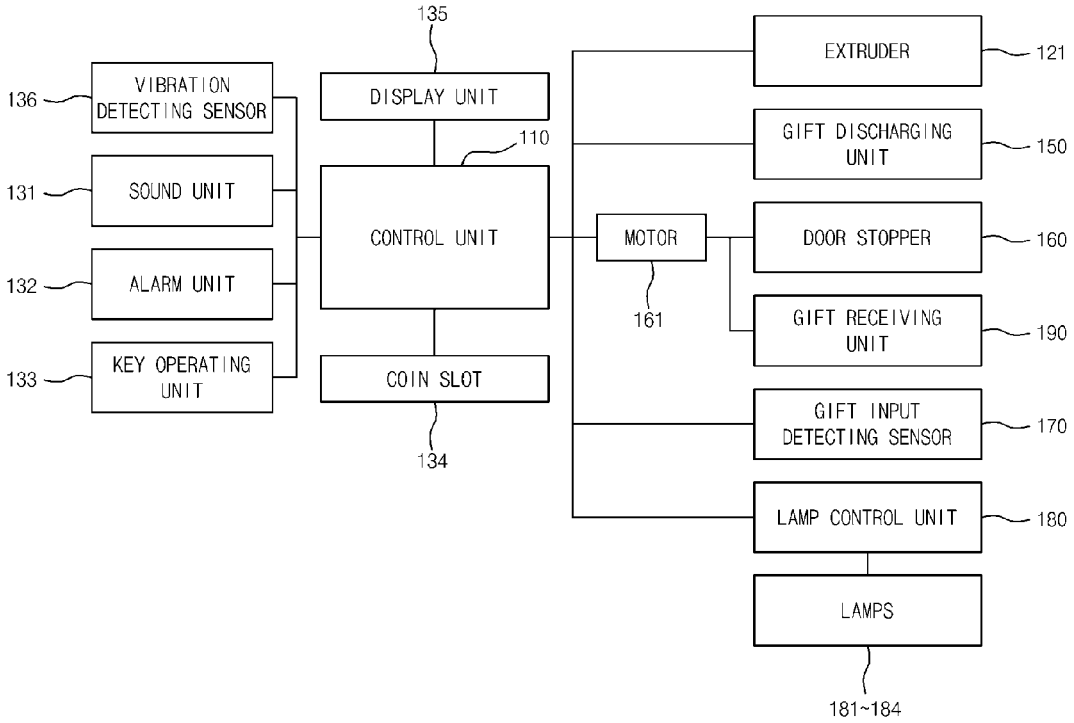
FIG. 3 is a main block diagram of a game apparatus for discharging free gifts according to an embodiment of the present invention.
Figure 12:
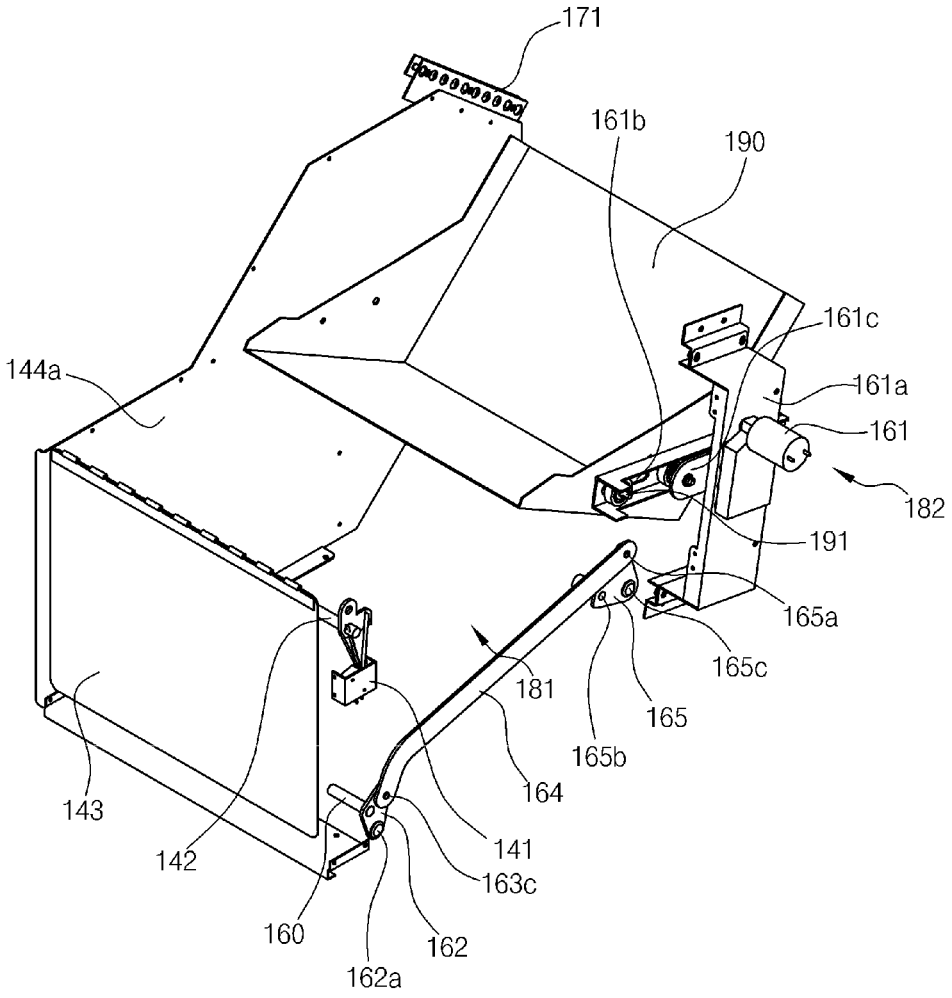
FIG. 12 is an illustration to explain a receiving state of the gift receiving unit according to one embodiment of the present invention.

FIG. 3 is a main block diagram of a game apparatus for discharging free gifts according to an embodiment of the present invention, and FIG. 12 is an illustration to explain a receiving state of the gift receiving unit, according to one embodiment of the present invention. As illustrated in the drawings, the game apparatus for discharging free gifts, according to the present invention, may include: a gift showcase 19 in which free gifts are displayed in a leftward/rightward (X) direction or an upward/downward (Y) direction; an extruder that has a rod-shaped member which is driven to be moved forward or backward, in a direction Z in which the free gifts are displayed, within a plane located at an outer side of the gift showcase; a key operating unit 133 for moving the extruder 121 in the leftward/rightward (X) direction or the upward/downward direction (Y); a gift receiving unit 190 that receives the free gift obtained from the gift showcase 19 and is rotated to enable the free gift to turn to a discharge unit or a storage unit; a vibration detecting sensor 136 that detects vibration of the game apparatus; a gift input detecting sensor 170 that detects whether or not the free gift is inputted in the gift receiving unit 190; a gift discharging unit 150 that discharges the free gifts; and a control unit 110 that controls a rotation direction of the gift receiving unit 190 according to whether or not vibration is detected by the vibration detecting sensor 136 when the free gift is judged to be put in the gift receiving unit 190 by the gift input detecting sensor 170.

Also, the game apparatus for discharging free gifts may further include: a door 143 that is provided at an outer lower side of a frame and is rotated so that the free gift 20 can be discharged; a sound unit 131 for generating sound effects; an alarm unit 132 for generating an alarm when vibration is detected; and a coin slot 134.

The coil slot 134 may be comprised of a typical sensor for detecting the input of coins and the like, or a typical bill sensing device for detecting the input of bills, cards, or substitutes in a bill slot or a card reader.

The sound unit 131 typically generates sound effects required to play games in order to stimulate interest in the games, and these generated sound effects are activated by an ordinary control program input into the control unit 110 in advance.

A display unit 135 may be configured to be turned on or off in order to increase a visual effect or interest in the game and may be installed at various positions of the game apparatus. To this end, the display unit 135 may be comprised of a seven-segment display or light-emitting diode (LED).

The vibration detecting sensor 136 is a device configured to detect whether or not vibration of the game apparatus occurs.

The gift showcase 19 stores the free gift 20 and is operated according to a result of driving the extruder 121 so that the free gifts fall to the gift receiving unit 190, one by one.

First, the gift showcase 19 in the present invention is comprised of two or more betting zones distinguished by betting sums of money, and is configured such that different free gifts are displayed in the betting zones.

"The betting zones" in the present invention refer to regions that include one or more different free gifts corresponding to the same betting sum of money in the gift showcase and are set to be distinguished by the betting sums of money, and the betting zones may be dividing into at least one combination of layers, rows, or regions.

Figure 4:
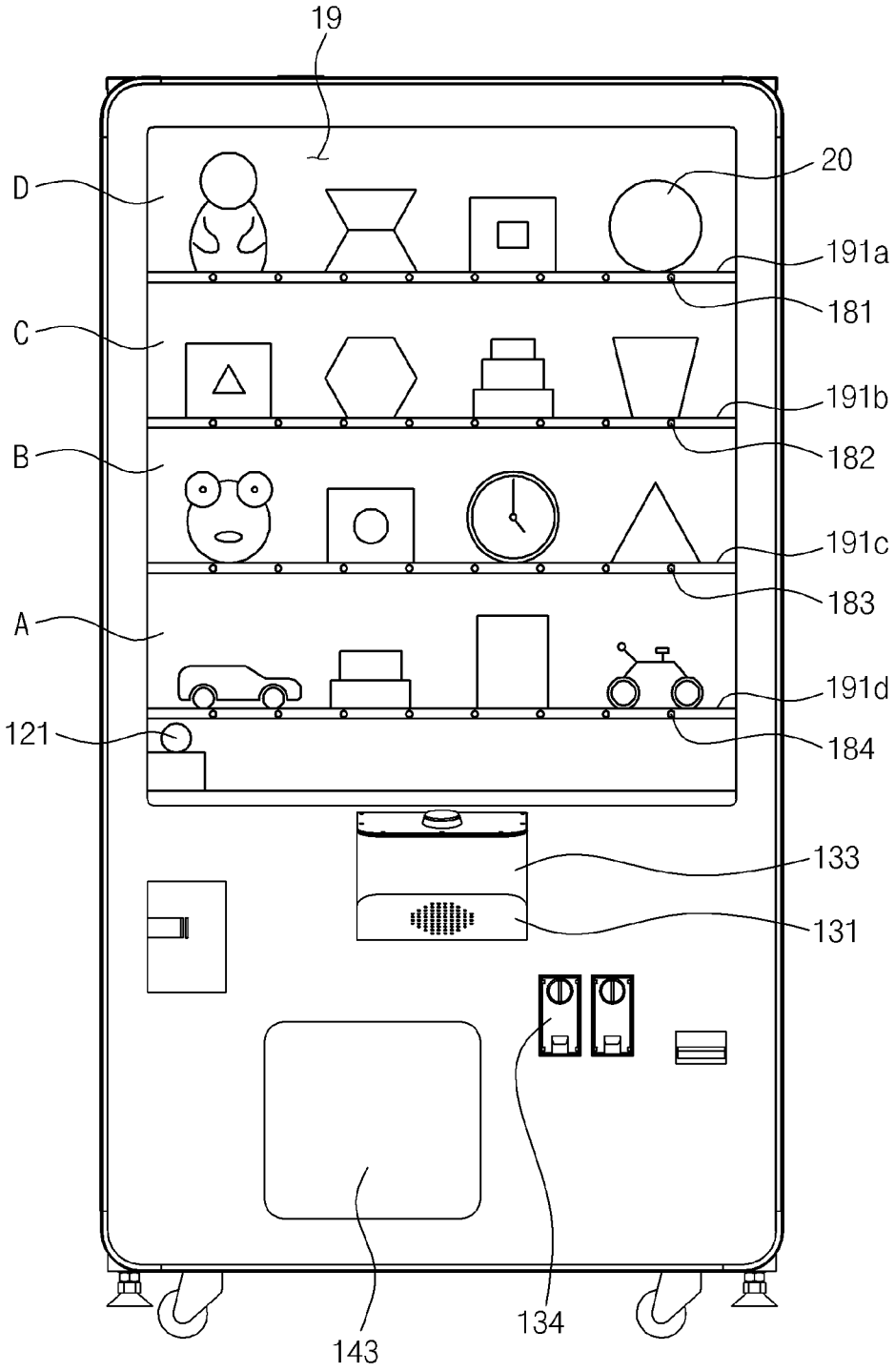
FIG. 4 is an illustration of horizontal betting zones in one embodiment, according to one embodiment of the present invention.
Figure 6:
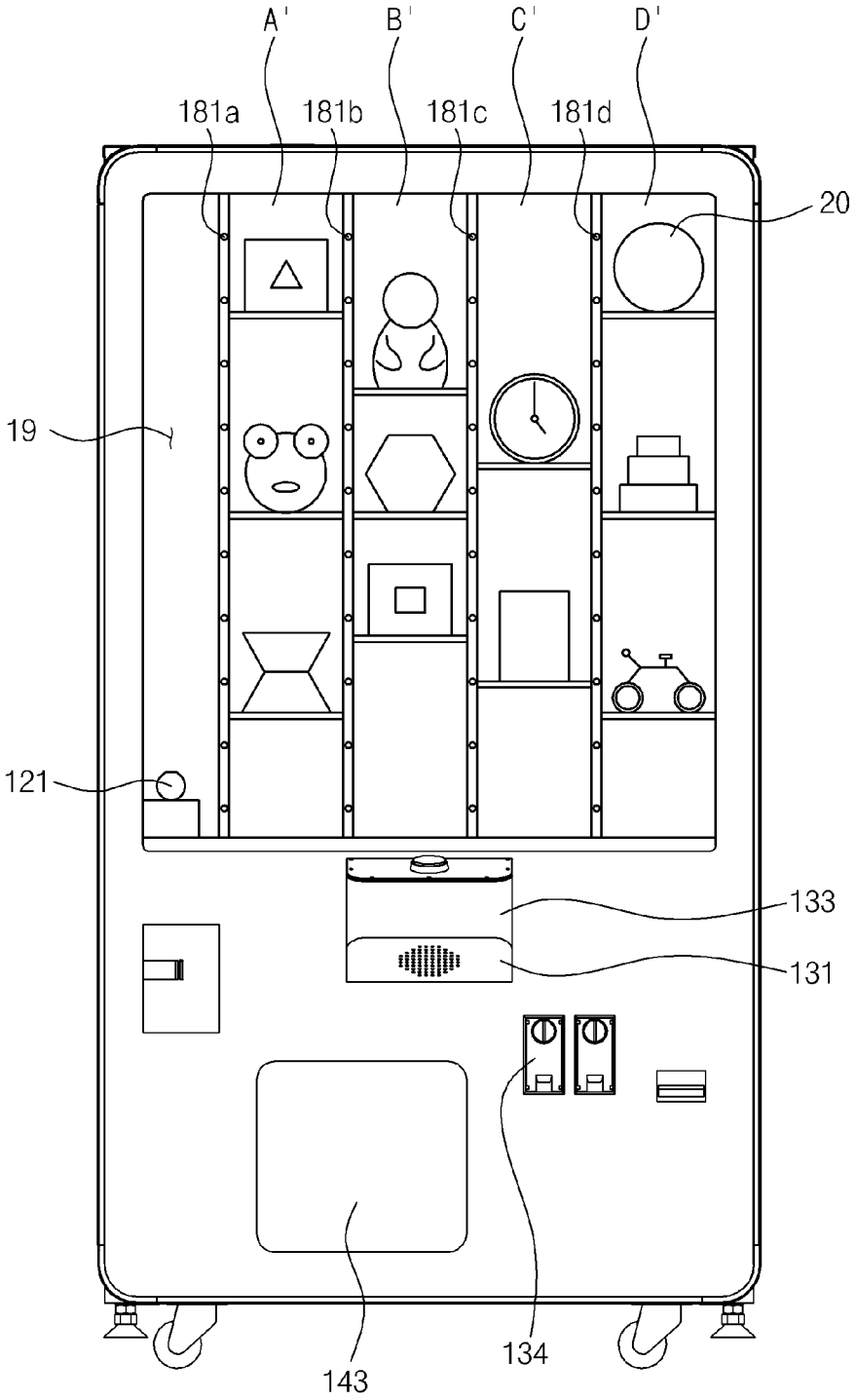
FIG. 6 is an illustration of vertical betting zones in one embodiment, according to one embodiment of the present invention.
Figure 8:
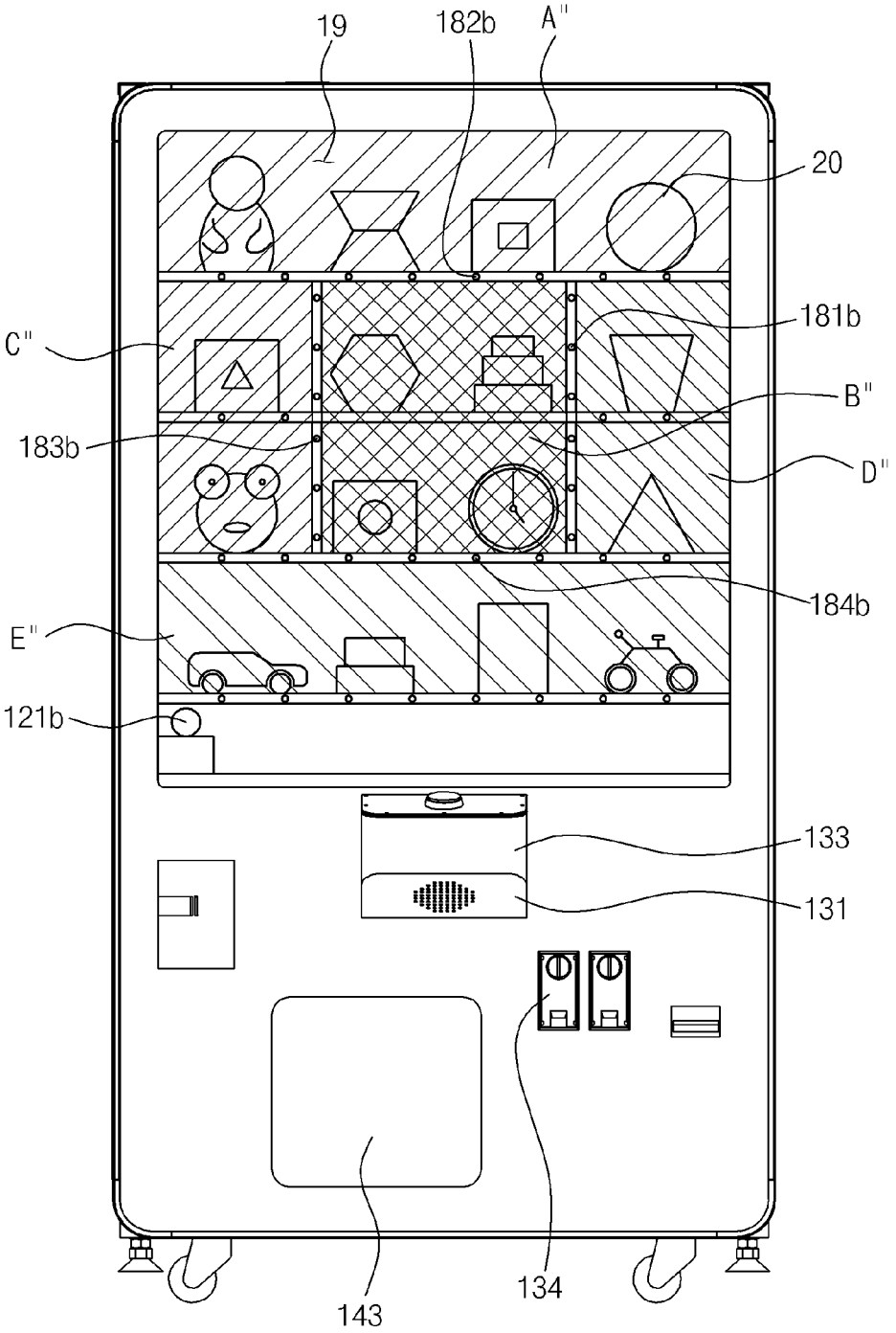
FIG. 8 is an illustration of betting zones for each region in one embodiment, according to one embodiment of the present invention.

For example, FIG. 4 shows that the betting zones are divided into layers, namely, the betting zones are arranged in four layers (A to D), FIG. 6 shows that the betting zones may be divided into rows, and FIG. 8 shows that the betting zones are divided into predetermined regions.

Referring to FIG. 4, the betting zones are arranged in four layers of A, B, C, and D and are distinguished by different betting sums of money. The betting sums of money of each layer are displayed so that a gamer can easily confirm a betting sum of money of a layer on which a desired free gift is arranged.

In this case, when the gamer starts to play a game after setting a betting sum of money of a desired layer, the extruder 121 is automatically moved to the layer corresponding to the betting sum of money, and when the movement of the extruder to the corresponding layer is completed, the gamer hits a desired free gift by operating the extruder leftward and rightward using the key operating unit 133 until the extruder reaches a position where the desired free gift provided in the corresponding layer is placed.

Of course, at this time, a case in which the extruder is automatically moved to the layer corresponding to the betting sum of money, and a case in which the gamer can perform key operation, are displayed to be distinguished through the sound unit 131 or the display unit 135, thereby enabling the gamer to progress in the game more effectively.

For example, the A, B, C, D layers of the betting zones are distinguished by the betting sums of money of 1,000 won, 2,000 won, 3,000 won, and 4,000 won, respectively, and when the gamer has set the betting sum of money of 2,000 won, the extruder is automatically moved to the B layer corresponding to the betting sum of money, and when the movement to the corresponding layer has been completed, the gamer can hit the desired free gift of the free gifts arranged at the B layer by performing the key operation leftward and rightward.

At this time, in the present invention, a lamp control unit 180 is further provided so that the betting zone selected by the gamer can be easily distinguished from the other betting zones.

The lamp control unit 180 enables the gamer to easily distinguish the selected betting zone from the other betting zones by turning off lamps 181, 182, 183, 184 arranged at the layer corresponding to the betting sum of money as described above through control of the control unit 110 (infra).

Figure 5:
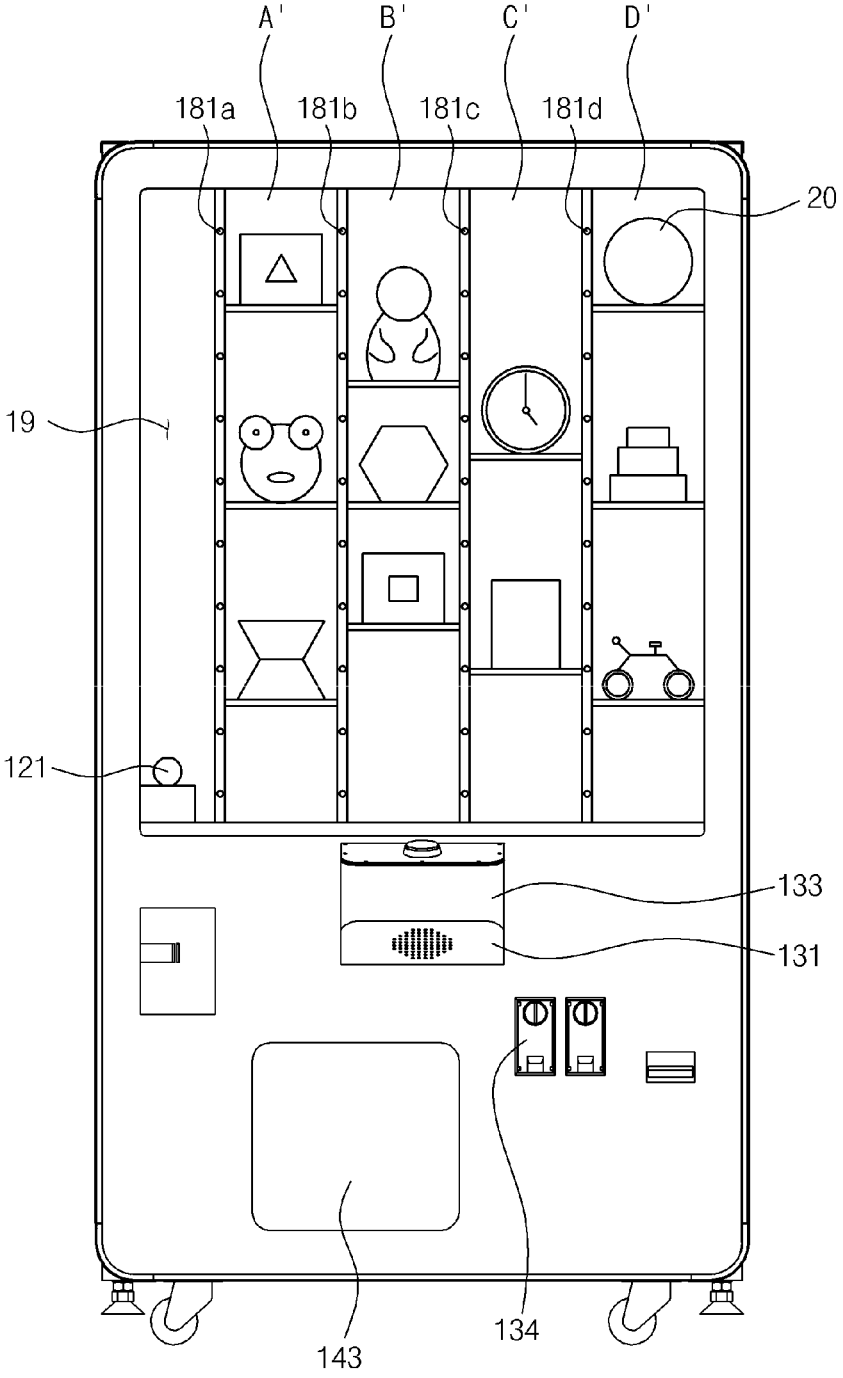
FIG. 5 is an illustration to explain the operation of an extruder in FIG. 4.

Referring to FIG. 5, the lamp 183 of the layer (the B layer) corresponding to the betting sum of money of 2,000 won selected by the gamer is turned off, and at the same time, the extruder is automatically moved to the B layer.

As described above, when the gamer would like to bet an amount of 2,000 won, he or she typically selects the betting sum of money of 2,000 won by increasing the betting sum of money from the lowest value of the betting sum of money (a predetermined betting sum of money, for example, 1,000 won). Thus, when the amount of 1,000 won is first bet, the lamp 184 of the layer (the A layer in FIG. 4) corresponding to the betting sum of money of 1,000 won is turned off, and thereafter, when the amount of 2,000 won is bet, the lamp of the B layer is turned off.

This is intended to enable the gamer to easily find the layer in which the desired free gift is arranged in each layer according to the betting sums of money placed.

In one embodiment, an example in which the lamp 184 is provided at the bottom of each layer of the gift showcase 19 is shown, but the lamp may be provided at the ceiling of each layer or at the top and bottom of each layer (or the ceiling and bottom).

Figure 7:
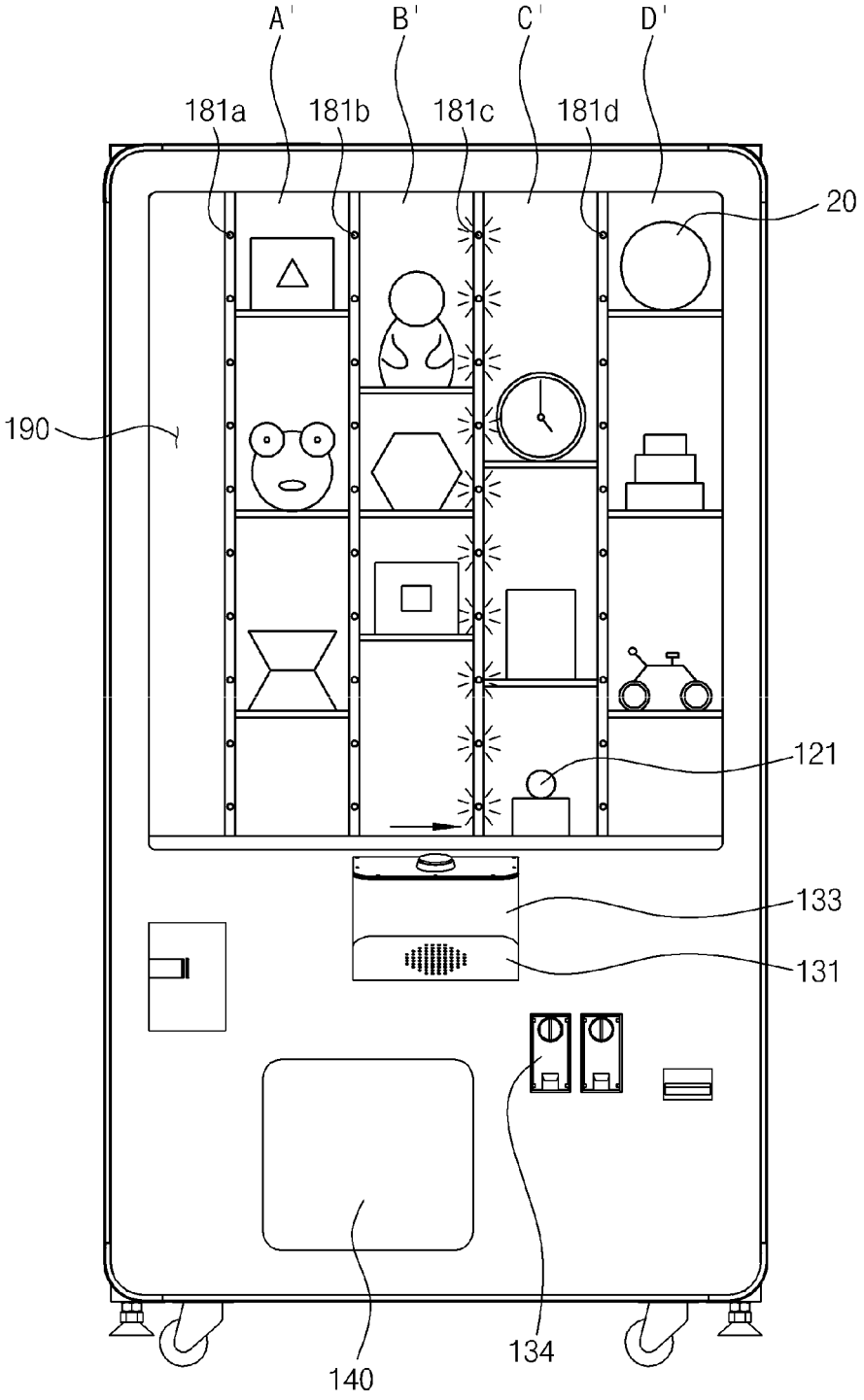
FIG. 7 is an illustration to explain the operation of the extruder in FIG. 6.

Also, referring to FIG. 6 illustrating vertical betting zones as one example, and also in FIG. 7, the drawings illustrate an example in which the betting zones are arranged in four rows (A' to D').

Referring to the drawings, the betting zones are arranged to be divided into four rows of A', B', C', and D' by different betting sums of money. The betting sums of money of each row are displayed so that the gamer can easily confirm a betting sum of money of a layer on which a desired free gift is placed.

In this case, when the gamer sets the betting sum of money of the desired row and starts to play a game, the extruder 121 is automatically moved to the row corresponding to the betting sum of money, and when the movement of the extruder to the corresponding row has been completed, the gamer can hit the corresponding free gift through upward and downward key operation.

Of course, at this time, the situation in which the extruder is automatically moved to the row corresponding to the betting sum of money, and the situation in which the gamer can perform the key operation, are displayed to be distinguished through the sound unit 131 or the display unit 135, thereby enabling the gamer to progress the game more effectively.

For example, the A', B', C', and D' rows of the betting zones are distinguished by the betting sums of money of 1,000 won, 2,000 won, 3,000 won, and 4,000 won, respectively, and when the gamer has set the betting sum of money of 3,000 won, the extruder is automatically moved to the C' row corresponding to the betting sum of money, and when the movement of the extruder to the corresponding row has been completed, the gamer can hit the desired free gift arranged at the C' row through upward and downward key operation.

At this time, as described above, the lamp control unit 180 enables the gamer to easily distinguish the betting zone selected by the gamer from the other betting zones by turning off lamps 181*a*, 181*b*, 181*c*, and 181*d* arranged at the row corresponding to the betting sum of money.

Referring to FIG. 7, the lamp 181*c* of the C' row corresponding to the betting sum of money of 3,000 won selected by the gamer is turned off, and at the same time, the extruder is automatically moved to the C' row.

Figure 9:
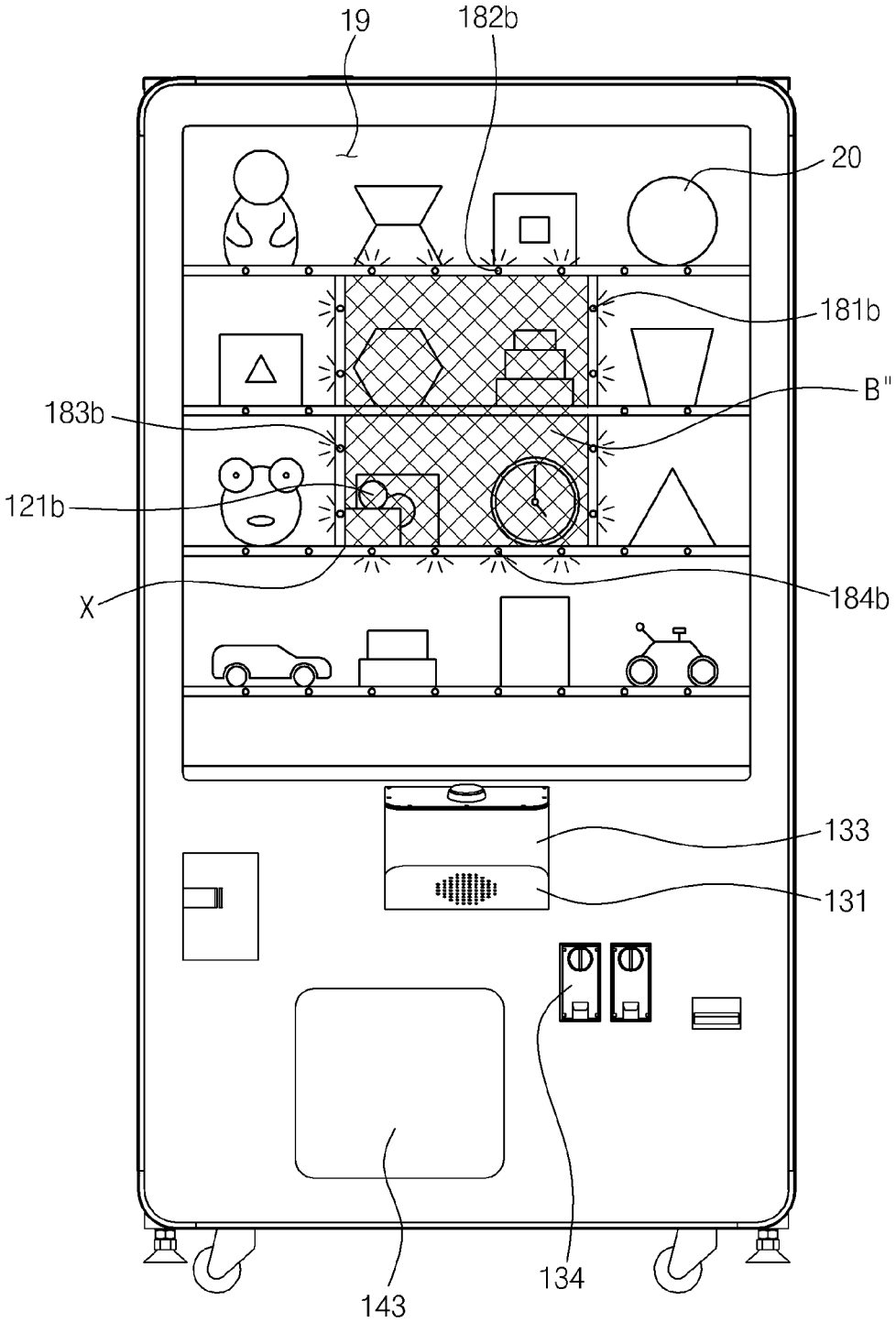
FIG. 9 is an illustration to explain the operation of the extruder in FIG. 8.

Furthermore, referring to FIG. 8 in which betting zones are indicated as regions, and also in FIG. 9, the drawings illustrate an example in which the betting zones are arranged as betting zones A"~E" comprised of columns and rows.

Referring to the FIGS. 8 and 9, the betting zones are divided into five regions viz. A", B", C", D", and E" and are arranged to be distinguished by different betting sums of money.

In this case, when the gamer sets the betting sum of money of a desired betting zone and starts to play a game, the extruder 121 is automatically moved to the region corresponding to the betting sum of money, and when the movement of the extruder to the corresponding region is completed, the gamer can hit the corresponding free gift through upward and downward key operation.

At this time, even though the example in which the lamp 184 is provided at the left side of each row is shown, the lamp may be provided at the right side of each row, or at the left and right sides of each row.

FIG. 8 shows that each layer is distinguished by the betting sums of money, and a region formed in two rows and two layers is selected as the betting zone B".

Of course, at this time, the situation in which the extruder is automatically moved to the betting zone corresponding to the betting sum of money, and the situation in which the gamer can perform the key operation, are displayed to be distinguished through the sound unit 131 or the display unit 135, thereby enabling the gamer to progress in the game more effectively.

For example, the A", B", C", D", and E" regions of the betting zones are distinguished by the betting sums of money of 1,000 won, 5,000 won, 2,000 won, 4,000 won, and 3,000 won respectively, and when the gamer has set the betting sum of money of 5,000 won, the extruder is automatically moved to the B" region corresponding to the betting sum of money, and when the movement of the extruder to the corresponding region has been completed, the gamer can hit the desired free gift arranged in the B" region by performing the left-and-right and up-and-down key operations.

At this time, since the betting zones are formed of two rows and two layers, the key operation may be naturally performed upward and downward, or leftward and rightward.

Referring to FIG. 9, lamps 181*b*, 182*b*, 183*b*, and 184*b* of the region B" corresponding to the betting sum of money of 5,000 won selected by the gamer are turned off, and at the same time, the extruder is automatically moved to an X point which is a starting point for the region B".

The key operating unit 133 includes up-and-down and left-and-right movement keys for moving the direction of the extruder which is necessary for operating the game apparatus for discharging free gifts; a betting switch for inputting a betting number; a starting switch for inputting a game starting signal. A brown tube monitor or other typical devices, such as a PDP, an LCD, and the like, which enable game images and words, such as scores, to be outputted on a screen thereof, are used as the display unit 135.

The gift discharging unit 150 may have the door 143 located at a position on a front lower side of the game apparatus where the gamer can easily pick up the free gift and is located on an extension of the discharge unit 181 for discharging the free gift from the gift receiving unit 190.

As described above, the free gift dropped according to a result of playing the game is received in the gift receiving unit 190, and the free gift received in the gift receiving unit 190 is controlled to be discharged through a gift storage unit 182 and a discharge unit 181.

Figure 10:
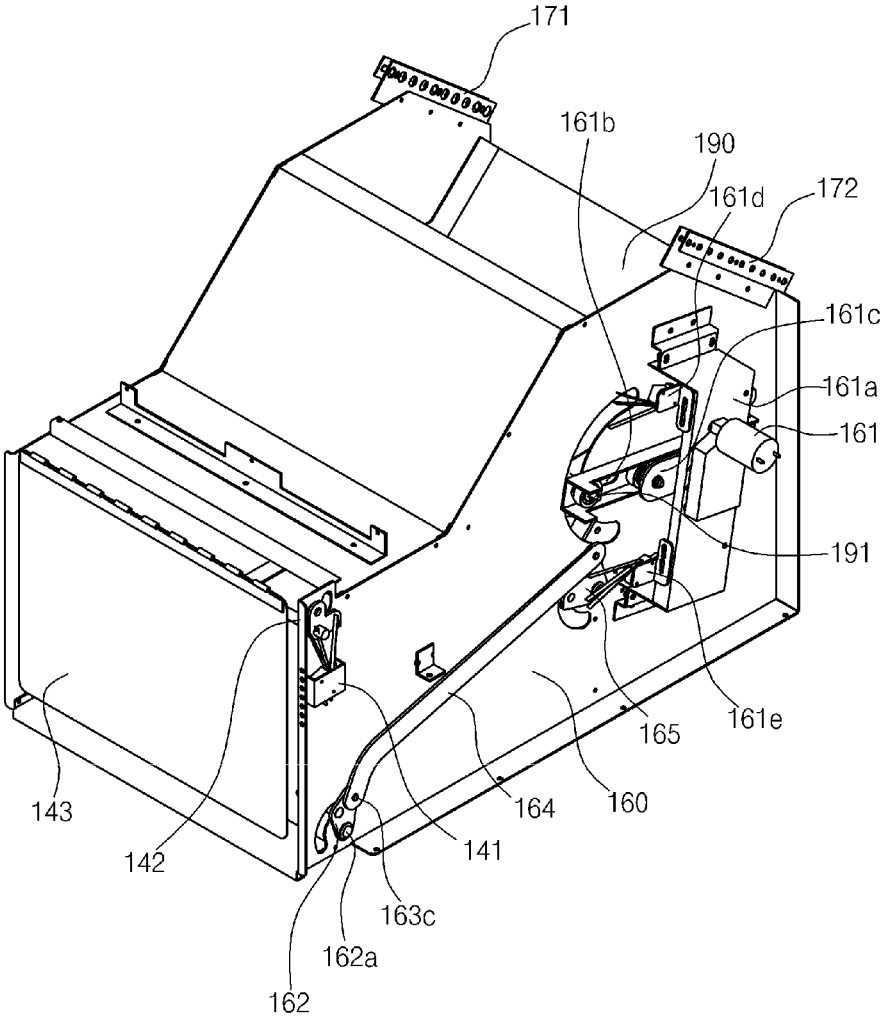
FIG. 10 is an enlarged perspective view of a gift receiving unit and a door.

Referring to FIG. 10, an enlarged perspective view illustrating the gift receiving unit and the door of the present invention, the gift storage unit 182 refers to a space that is installed at a lower portion of the inside of the game apparatus for discharging a free gift so that the free gifts are discharged to the outside, and the discharge unit 181 refers to a space for discharging the free gifts that is formed between the gift receiving unit 190 and the door 143.

The control unit 110 enables the gift receiving unit 190 to be rotated so as to be in a state of receiving the free gifts during the game, enables the gift receiving unit 190 to be rotated so that a discharging direction of the free gifts received in the gift receiving unit 190 turns to the discharge unit 181 when vibration is not detected by the vibration detecting sensor 136, and controls the gift receiving unit 190 so that the discharging direction of the free gifts in the gift receiving unit 190 turns to the storage unit 182 when vibration is detected.

To do so, the gift receiving unit 190 is shaped in a basket form, and the control unit 110 controls the gift receiving unit to be in a standby state in which the free gifts of the gift receiving unit 190 are positioned to turn to the gift storage unit 182, a receiving state in which the free gifts are rotated to be received during the game, or an ending state in which the collected free gifts are controlled to turn to the discharge unit 181 or the gift storage unit 812.

Hereinafter, a state in which the free gifts received in the gift receiving unit are rotated in a direction of the discharge unit will be referred to as a discharge state, and a state in which the free gifts received in the gift receiving unit are rotated in a direction of the storage unit will be referred to as a storage state.

Also hereinafter, the discharge state and the storage state will be designated as the ending state.

The storage state refers to the same state as the standby state in consideration of the operation of the gift receiving unit.

Figure 11:
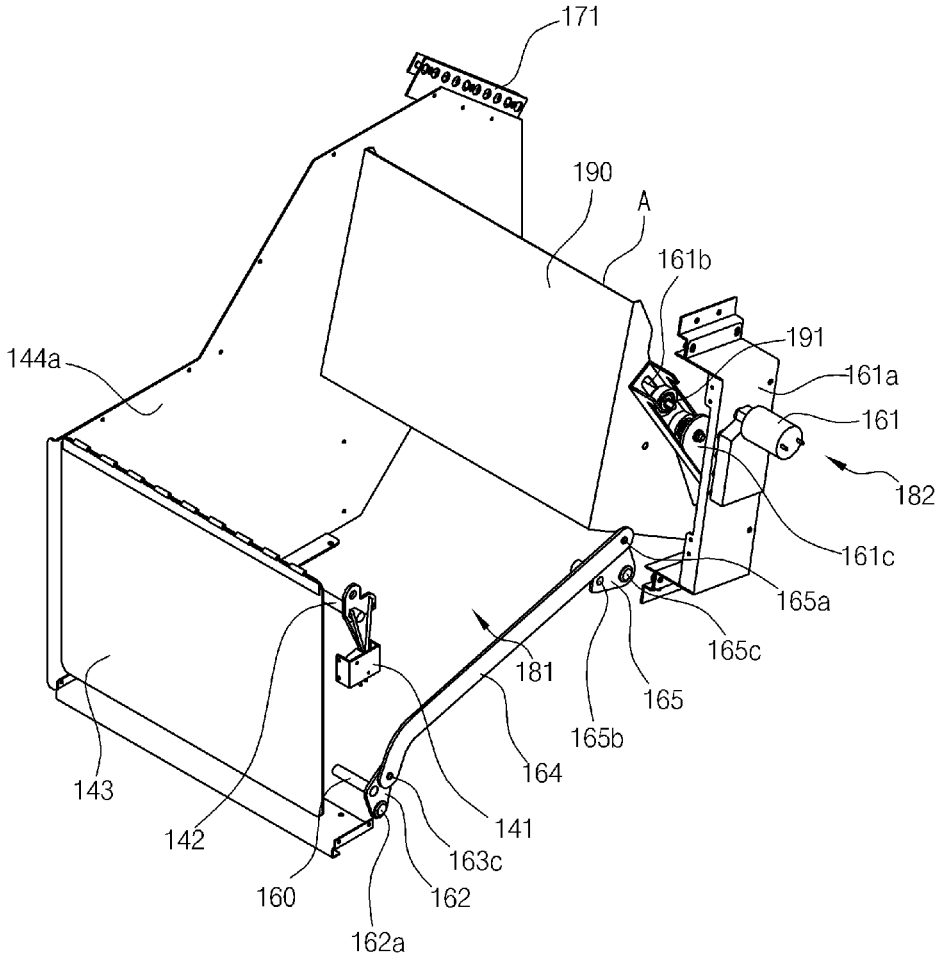
FIG. 11 is an illustration to explain a standby state of the gift receiving unit according to one embodiment of the present invention.
Figure 13:
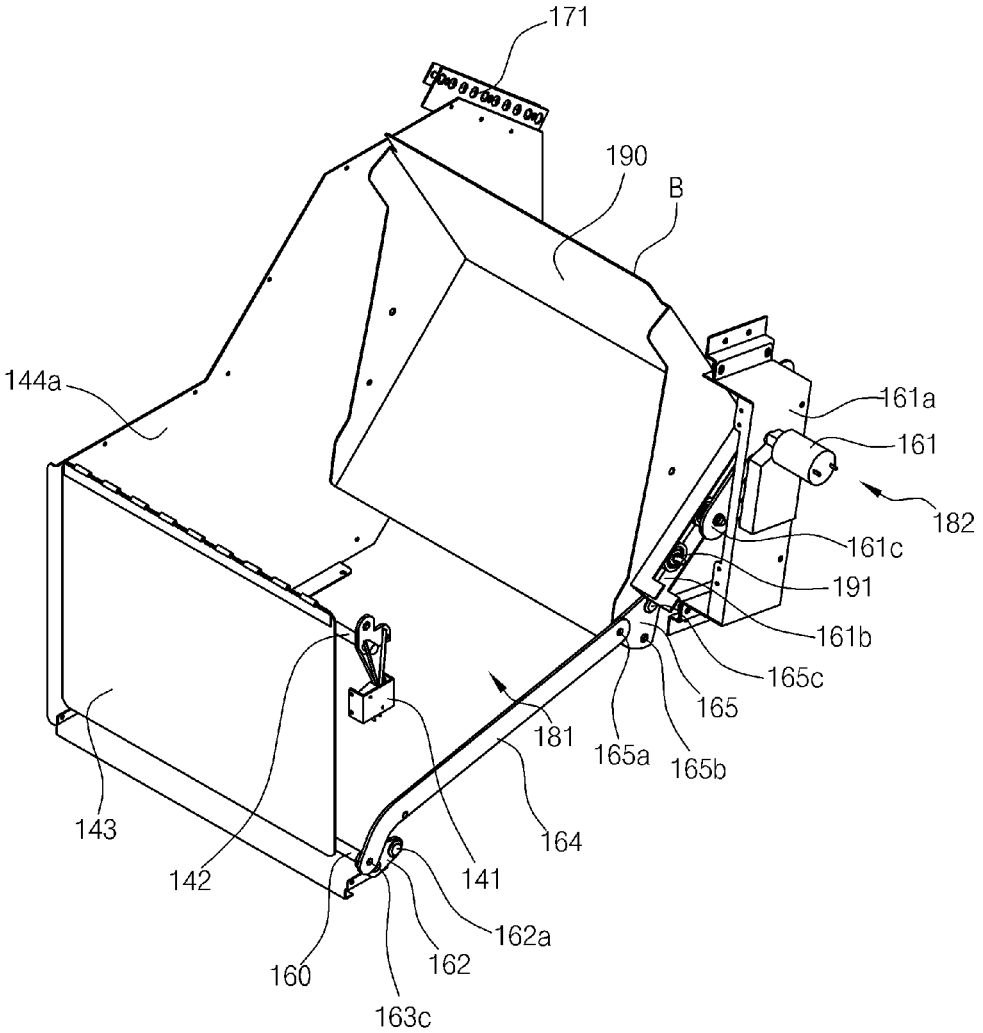
FIG. 13 is an illustration to explain an ending state of the gift receiving unit according to one embodiment of the present invention.

The operation of the gift receiving unit will be hereinafter described in more detail with reference to FIG. 11 illustrated to explain the standby state of the gift receiving unit according to one embodiment of the invention, and FIG. 12 illustrated to explain the receiving state of the gift receiving unit according to one embodiment of invention, and FIG. 13 illustrated to explain the ending state of the gift receiving unit according to one embodiment of the invention.

FIG. 11 illustrates the standby state before the free gifts are received in the gift receiving unit, and the standby state means a case in which the free gifts dropped from the gift showcase by an external compulsory impact are rotated so as not to be discharged to the discharge unit 181, but to be maintained in the storage unit 182 during a period before the game is played and until a predetermined time after starting of the game has passed.

Referring to FIG. 11, an opening of the gift receiving unit 190 is rotated to turn to the storage unit 182 and a rear surface of the gift receiving unit 190 to block passage of the discharge unit 181 through which the free gifts pass, thereby enabling the dropped free gifts to be kept in the storage unit 182.

The gift receiving unit 190 may be kept in the standby state by the control unit 100 before forward movement of the extruder 121 is performed through the key operating unit 133 after starting of the game.

The standby state is maintained during standby of the game and until a predetermined time after starting of the game has passed.

Referring to FIG. 12 illustrated to explain the receiving state of the gift receiving unit according to one embodiment of the invention, when a predetermined time has passed after starting of the game, the control unit 110 enables the state of the gift receiving unit 190 to be changed to the receiving state by driving a motor 161 so that the free gifts dropped from the gift showcase can be received.

Such a change from the standby state to the receiving state may be performed when the extruder 121 is moved forward.

Since the movement of the extruder 121 is performed in such a manner that the extruder is automatically moved to a position where the betting zone, bet by the gamer, is located after starting of the game, is then moved upward and downward, or leftward and rightward by key operation of the key operation part 133, and thereafter a forward action of the extruder 121 is performed, all free gifts dropped by an external impact at this time are kept in the storage unit 182, and the state of the gift receiving unit is changed to the receiving state in order to receive the free gifts falling when the forward action of the extruder is performed.

For this, the control unit 110 controls the state of the gift receiving unit 190 by driving the motor 161, and the driving of the motor 161 will be described in detail below.

The receiving state of the gift receiving unit 190 results from adjusting a position of the gift receiving unit 190 so that the opening of the gift receiving unit 190 turns to an upward direction in which the free gifts fall.

That is, the receiving state refers to a state in which the dropped free gifts are received in the gift receiving unit, in the form of a basket, not to be discharged to the storage unit 182 or the discharge unit 181, and the receiving state is changed to the ending state in which the received free gifts are discharged from the gift receiving unit 190 to the discharge unit 181 or the storage unit 182 by control of the control unit 110.

Referring to FIG. 13 illustrated to explain the ending state of the gift receiving unit according to one embodiment of the invention, FIG. 13 illustrates a state in which the free gifts of the gift receiving unit 190 are rotated to be discharged to the discharge unit 181 by the control unit 110 driving the motor 161.

The control unit 110 controls the discharge state of the free gifts received in the gift receiving unit 190, namely, a discharging direction of the free gifts to turn to the discharge unit 181 when the free gifts are judged to be received in the gift receiving unit 190, and vibration is not detected by the vibration detecting sensor, or the control unit 110 controls the storage state, namely, the discharging direction of the free gifts to turn to the storage unit 182 when vibration is detected.

That is, when the free gifts are judged to be received in the gift receiving unit 190, and according to whether or not vibration is detected by the vibration detecting sensor, the control unit 110 controls the gift receiving unit so that the free gifts are discharged through the discharge unit 181 or the storage unit 182.

Changing the control state of the gift receiving unit to the ending state, namely, the discharge state or storage state may be performed according to whether or not vibration is detected by the vibration detecting sensor when a backward action of the extruder 121 is detected.

Of course, when it is judged that the free gifts are not received in the gift receiving unit 190, regardless of whether or not vibration is detected by the vibration detecting sensor 136, the control unit 110 may enable the standby state to be finished by driving the motor 161 so that a rotation direction of the gift receiving unit 190 turns to the storage unit 182.

Hereinafter, the detailed configuration in which the state of the gift receiving unit is controlled will be described.

A fixing bracket 161*a* for the motor 161 is fixed to a gift discharging bracket 160, and the motor 161 is connected to the bracket 161*a* for fixing the motor. A shaft of the motor 161 is configured so as to rotate a hinge bracket 161*c*. When the hinge bracket 161*c* is rotated, a roller provided at one end of the hinge bracket 161*c* is rotatably inserted into a rotating bracket 161*b* which is slidably operated, thereby rotating the rotating bracket 161*b*. Furthermore, the roller 191 connected to one end of the gift receiving unit 190 inserted into a long hole provided at one side of the rotating bracket 161*b* is moved upward and downward by rotation of the long hole, thereby enabling the state of the gift receiving unit 190 to be controlled.

The rotation means of the gift receiving unit may be variously configured, and if a configuration enables rotation states of the gift receiving unit to be distinguished according to each step and to be controlled under a simple structure, the configuration can be applied to the present invention, and accordingly, the present invention is without limitation to the aforesaid configuration.

Also, as in one embodiment of the invention, even though the standby state, the receiving state, and the ending state are described, for making the configuration more simple, the gift receiving unit may be configured to be driven in a state of receiving the free gifts, a state of discharging the free gifts, or a state of keeping the free gifts.

That is, if a configuration enables a state of the free gift received in the gift receiving unit to be changed to a receiving state during the game and enables the free gift to be controlled to turn to the discharge unit or the storage unit, the configuration can be applied to the present invention, and accordingly, a control state is without limitation.

In addition to this, to both ends of the opening of the basket shaped gift receiving unit 190, sensors (not drawn) are attached at a position which enables the gift receiving unit to be rotated maximally. When rotation is detected by each of the sensors upon the rotation of the gift receiving unit 190, the rotation is stopped, thereby enabling the rotation of the gift receiving unit to be controlled.

Referring to FIG. 10, a first sensor 161*d* and a second sensor 161*e* are provided at an upper portion and a lower portion of the fixing bracket 161*a*, respectively, and the control unit 110 controls the gift receiving unit 190 so that rotation of the gift receiving unit is stopped when the sensors 161*d*, 161*e* are detected according to rotation of the bracket 161*b* rotated in a state of being attached to a side of the gift receiving unit 190.

That is, in a case where a state of the gift receiving unit 190 is converted into the standby state and is then rotated, when the bracket 161*b* comes into contact with the first sensor 161*d*, and thus the sensor is operated, the control unit 110 stops the rotation in the standby state. In a case where a state of the gift receiving unit 190 is converted into the discharge state and is then rotated, when the bracket 161*b* comes into contact with the second sensor 161*e*, and thus the sensor is operated, the control unit 110 stops the rotation in the discharge state in order to control the gift receiving unit so that the gift receiving unit is not rotated by force.

Even though this embodiment of the invention shows that the sensors are operated using the bracket attached to the gift receiving unit, the present invention is not limited to such a configuration, and if a configuration enables a rotation state of the gift receiving unit to be detected, then that configuration may also be applied to the present invention.

That is, to both ends of the opening of the basket shaped gift receiving unit 190, the sensors (not shown) are attached at a position which enables the gift receiving unit to be rotated maximally. The gift receiving unit 190 may be configured such that when the gift receiving unit 190 is rotated such that the both ends of the opening are rotated at the largest rotation angle, the corresponding sensor is operated, and the state of the gift receiving unit 190 may be accurately controlled because the motor 161 can be controlled so that the gift receiving unit 190 is not rotated more than is needed.

Referring to FIGS. 11 and 13, as each tip (A, B) of the gift receiving unit 190 is rotated, a sensor positioned near the largest rotation angle is operated, and thus the rotation of the gift receiving unit to a corresponding state is stopped.

This sensor is effective in preventing the gift receiving unit from being damaged due to excessive rotation.

Also, when the free gift is judged to be received in the receiving state of the gift receiving unit, and vibration is detected by the vibration detecting sensor 136, the control unit 110 controls the gift receiving unit so that the discharging direction of the free gift received in the gift receiving unit 190 turns to the storage unit 182.

Referring to FIG. 10, in the present invention, whether or not the free gift is received in the gift receiving unit 190 may be confirmed by light emitting and receiving sensors 171, 172 attached to an upper end of the opening of the gift receiving unit 190 so that operations of the sensors are detected when the free gift is dropped and is then received in the gift receiving unit 190.

The light emitting and receiving sensors 171, 172 are typical sensors, and accordingly, their detailed description is omitted.

Also, the control unit 110 may block an illegal action in such a manner that when vibration is detected, the alarm unit 132 generates a warning sound or sound effects in order to notify the fact that an external impact has been applied.

To do so, the control unit 110 controls rotation of the gift receiving unit 190 when vibration is detected by the vibration detecting sensor 136 during a period from the starting of the game to the ending of a game so that the received free gifts turn to the storage unit 182.

The gift receiving unit 190 is controlled in the receiving state upon forward driving of the extruder 121, and when the free gifts are judged to be received in the gift receiving unit 190 in the receiving state, and vibration is not detected by the vibration detecting sensor 136 upon backward driving of the extruder 121, a gift discharging direction of the gift receiving unit is controlled to turn to the discharge unit.

Accordingly, in the present invention, when the extruder 121 is moved backward in a state of the free gift being received in the gift receiving unit, the rotation direction of the gift receiving unit 190 is controlled so that the free gift 20 can be prevented from being discharged to the door 143, thereby enabling the free gift to be prevented from being discharged illegally by an external impact or vibration.

Also, since the free gift is discharged to the door when the extruder 121 is moved backward, a standby time for discharging of the free gift can be minimized, and the free gift can be prevented from being discharged by an illegal method.

Also, in the present invention, in order to prevent the free gifts from being illegally discharged through a door by blocking rotation of the gift receiving unit, a device capable of controlling an on/off state of the door may be configured.

That is, the door 143, which is rotated around the rotation axis of the upper end, and the stopper 160 configured to prevent the rotation of the door are formed at the discharge unit 180, thereby enabling the door to be prevented from being rotated.

In FIGS. 11 and 12, when the gift receiving unit 190 is in the standby state and in the receiving state, the stopper 160 is moved in an upward direction at the back side of a rotating direction of the door 143 so that a lower end of the door is caught by the stopper, thereby preventing the door 143 from opening. Then, as shown in FIG. 13, when the state of the gift receiving unit is changed to the discharge state, a position of the stopper 160 is moved in a downward direction so that the lower end of the door is released from the stopper 160 and the door is rotated.

That is, when the free gifts are normally discharged by controlling the rotation of the door 143, the door opens so that the free gift can be discharged.

Hereinafter, the configuration of rotation of the stopper will be described in one example with reference to the drawing.

FIG. 9 is a view for explaining a state in which the door is prevented from opening during the operation of a stopper according to one embodiment of the invention, and FIG. 10 is a view for explaining a state in which the opening of the door is not blocked during the operation of the stopper according to one embodiment of the invention.

Referring to the FIGS. 9 and 10, the stopper 160 includes: a first bracket 162 to which one side of the stopper 160 is connected, and which is rotated around a rotation axis 162*a*; a second bracket 165 that has a pressure rod 165*a* formed at one side thereof and is rotated around an axis 165*c*; and a bridge 164 connected so that the first bracket 162 is rotated by rotation of the second bracket 165.

In the stopper of such a configuration, when one side of the gift receiving unit 190 is pressurized by the pressure rod 165*b* of the second bracket 165 by the gift receiving unit 190 being rotated by the motor 161 in a direction of the discharge unit 181, the second bracket 165 is rotated around the rotation axis 165 according to rotation of the pressure rod 165*b*. The rotation is performed such that the first bracket 162 is rotated around the rotation axis 162*a* through the bridge 164, and thus a position of the stopper 160 is moved from an upward direction to a downward direction so that rotation of the door is not interrupted.

Accordingly, in a case where vibration is not detected by the vibration detecting sensor 136 and the free gift is received in the gift receiving unit 190, the control unit 110 controls the gift discharging direction of the gift receiving unit 190 to turn to the discharge unit 181 when the extruder 13 is moved backward, and at this time, the stopper 160 of the door functioning to prevent the door 143 from opening is rotated downward by the rotation of the gift receiving unit 190 so that the opening of the door is not interrupted.

Meanwhile, in the present invention, the configuration in which the stopper of the door is operated according to the discharging direction of the gift receiving unit is presented as one example. However, in order to prevent the free gifts from being discharged by an illegal method, even though the gift discharging direction of the gift receiving unit is controlled to turn to the discharge unit, the door can be prevented from opening in order to prevent the free gift from being discharged when illegal vibration is detected before the opening of the door is detected by the door opening detecting sensor, and a warning is provided through an alarm unit so that a manager of the game apparatus can retrieve the free gift loaded in the discharge unit 181.

Also, in a case where a rotation detecting sensor 140 for detecting a rotation angle of the door 143 is provided, and the stopper 160 is operated so that the door 143 is prevented from opening, an alarm unit 132 for making a predetermined alarm or warning indication emits a warning sound when rotation of the door 143 is detected by the rotation detecting sensor 140, thereby preventing the free gift from being discharged by the rotation of the door using an illegal method.

Referring to FIG. 10, a sensor rod 142 is provided at a position spaced at a predetermined angle in a rotating direction of the door that is rotated around a rotation axis of an upper end of the door 143, and a sensor 141 for detecting whether or not the door comes into contact with the sensor rod 142 is provided. Thus, when the door is detected by the sensor rod 142 because the door was being forcedly rotated, the sensor 141 transmits detection information to the control unit 100, and the control unit enables an alarm to be emitted through the alarm unit 132 so that the game manager can manage the free gift.

When the displayed free gift 20 is hit by the extruder, movement prevention devices 19*a*, 19*b* for preventing the free gift from being moved in a next step may be further provided.

Figure 15:
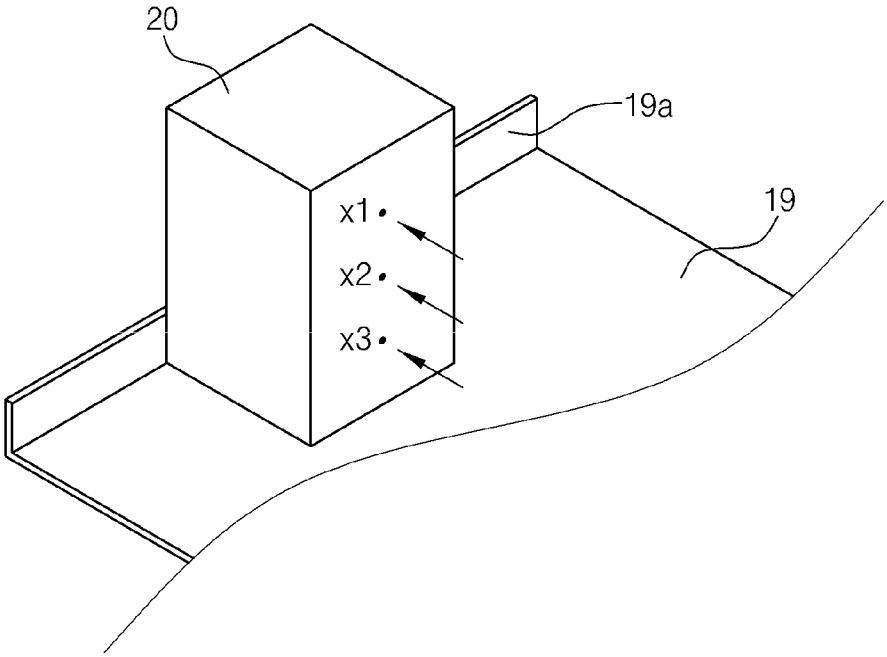
FIG. 15 is an illustration of a gift movement prevention device in one embodiment, according to one embodiment of the present invention.
Figure 16:
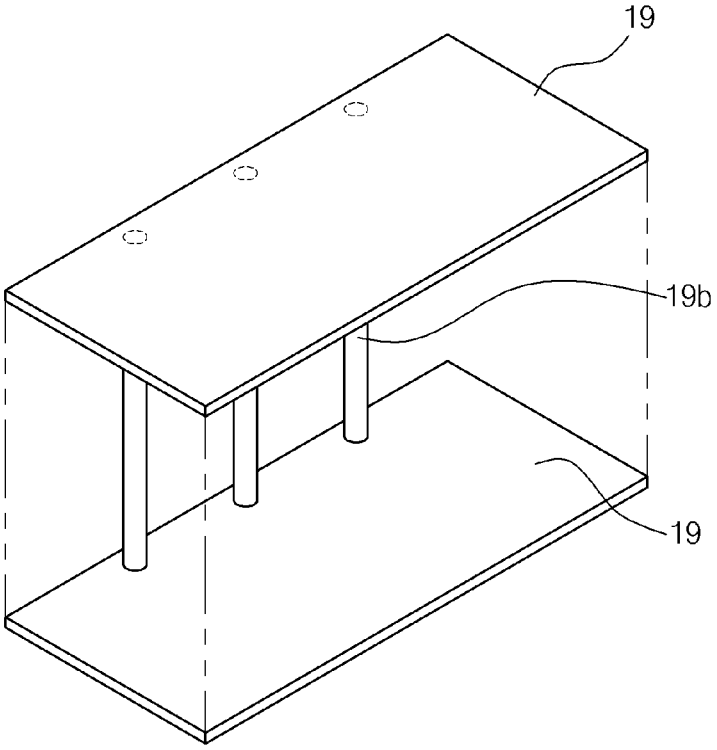
FIG. 16 is an illustration of a gift movement prevention device in one embodiment, according to one embodiment of the present invention.
Figure 17:
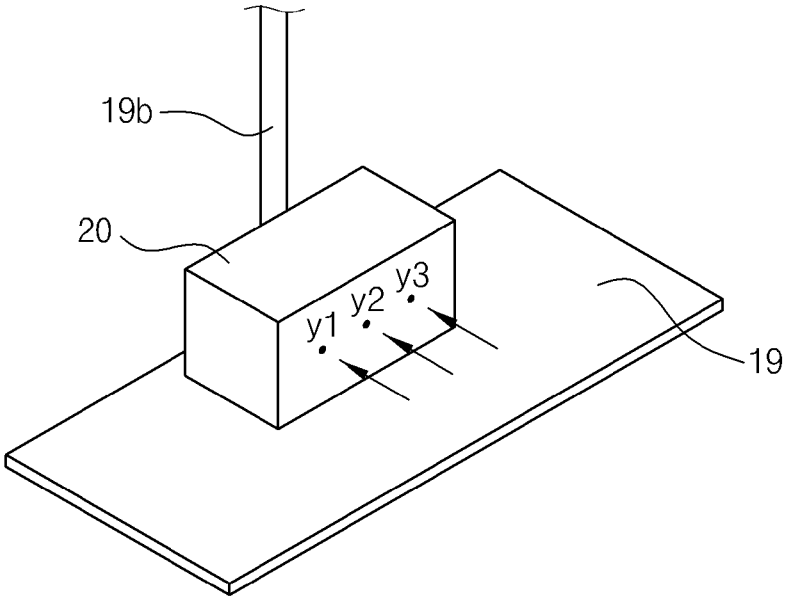
FIG. 17 is an illustration to explain the hit points of an extruder in FIG. 16.

FIG. 15 illustrates the gift movement prevention device as in one embodiment of the present invention, FIG. 16 illustrates the gift movement prevention device as in another embodiment of the present invention, and FIG. 17 illustrates hitting points of the extruder in FIG. 16, the movement prevention devices 19*a*, 19*b* for interrupting the movement of the free gift in a next step are further provided in order to stimulate interest in games and increase technical effects.

That is, referring to FIG. 15, a movement prevention projection 19*a*, a bottom surface of which protrudes in a predetermined height so that the free gift hit as a target is prevented from being moved in a next step, is installed at the back of the free gift 20. It is configured such that when the free gift is hit by the extruder 121, a hit portion of the free gift is appropriately divided into a top portion x1, a middle portion x2 and a bottom portion x3, and the free gift is more easily dropped to the gift receiving unit 190 when the top portion x1 is hit.

At this time, when a height of the movement prevention projection 19*a* is too high, the winning rate is reduced, and when the height thereof is too low, an effect of the movement prevention projection is reduced, and accordingly, there is a need to appropriately adjust the height.

Also, since the free gifts in a corresponding betting zone may have different heights, in consideration of this, the height of the movement prevention projection should be determined.

Referring to FIG. 16 as the gift movement prevention device, a connecting rod 19*b* having a predetermined thickness for connecting a bottom surface and a ceiling surface on which the free gifts are displayed is installed at the back of the free gift 20, thereby preventing the hit free gift from being moved in a next step.

That is, unlike the gift movement prevention projection 19*a*, the connecting rod 19*b* is configured so that the free gift can be more easily obtained when the right and left sides of the free gift are hit.

Referring to FIG. 17, since the connecting rod 19*b* having the predetermined thickness is installed at the back of the free gift, hitting points y1 and y3 of hitting points y1, y2, y3 should be appropriately selected and should be then hit in order to drop the free gift.

In one embodiment of the invention, even though the movement prevention projection 19*a* and the connecting rod 19*b* are described as examples of the movement prevention device, they are without limitation. If an element can prevent the free gift hit in the gift showcase from being moved in a next step by adding functional and mechanical factors, that element can be applied as the movement prevention device.

Based on the aforesaid configuration, an operation of the game apparatus for discharging free gifts according to one embodiment of the invention will be described with reference to the drawing.

Figure 14:
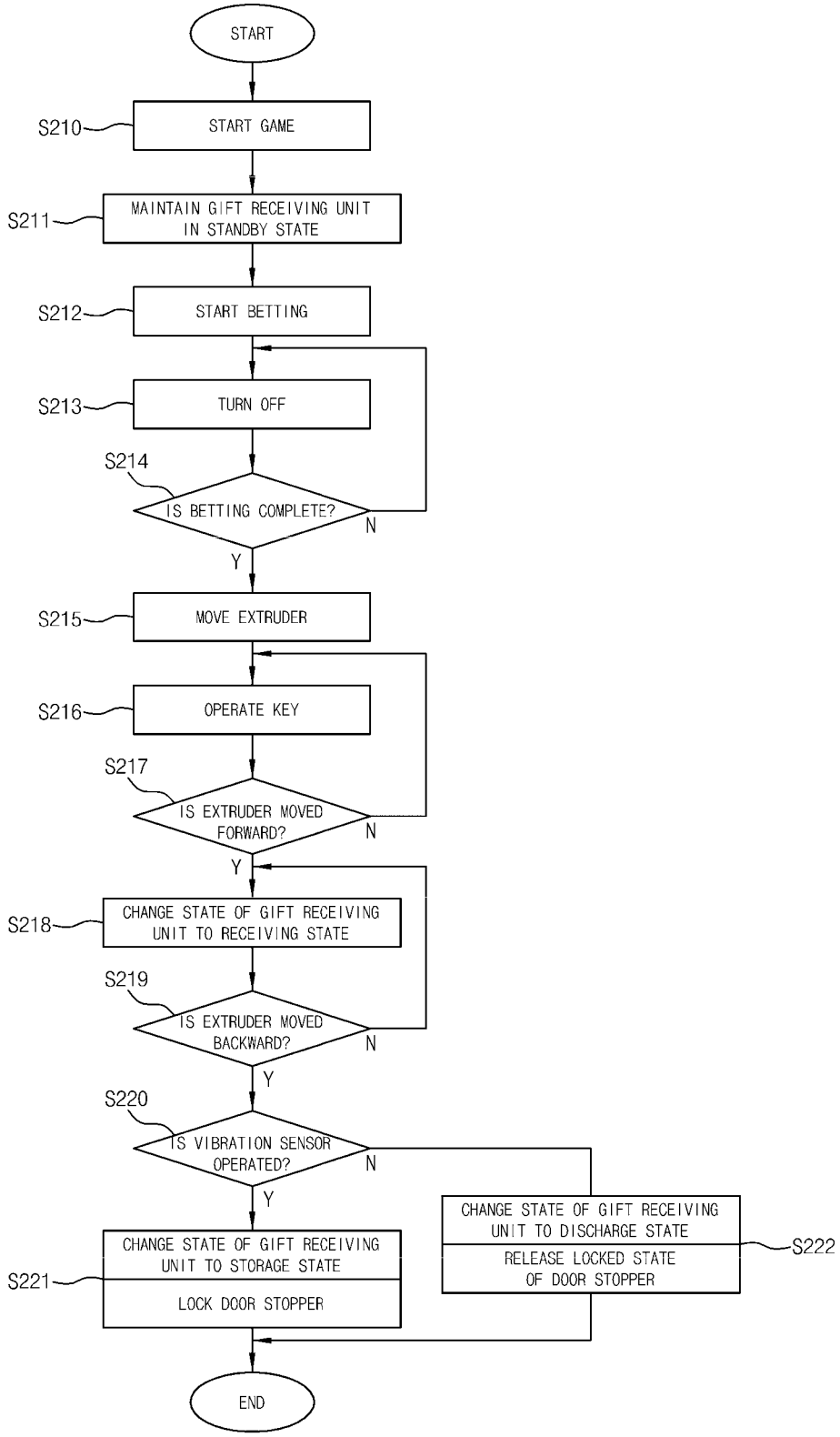
FIG. 14 is a flow chart illustration to explain a control method of the game apparatus according to one embodiment of the present invention.

FIG. 14 is a flow chart illustrated to explain a control method of the game apparatus according to one embodiment of the invention, and as illustrated in the drawing, in step S210, when a game is judged to be started, the control unit 110 maintains the gift receiving unit 190 in the standby state S211.

In step S211, the state of the gift receiving unit is maintained in the standby state, and when a gamer starts to bet a betting sum of money through key operation of the key operating unit 133 (S212), the control unit 110 controls the lamp control unit 180 so that the lamps corresponding to the betting sum of money are turned off (S213).

As shown in FIGS. 4 to 9, the control unit 110 controls the lamp control unit 180 so that the lamps corresponding to a layer, row or region corresponding to the betting sum of money are turned off (S213).

In step S213, when the gamer finally selects the betting sum of money, the control unit 110 enables the lamps provided in the corresponding betting zone to be turned off and the extruder to be automatically moved to the corresponding betting zone (S214~S215).

Whether or not the selection of the betting sum of money is completed may be judged as a predetermined time has passed after selecting the betting sum of money in the control unit 110, a starting button installed in the key operation part is pressed, or a predetermined betting time has passed.

Also, when the extruder is moved to the betting zone, the automatic movement of the extruder is displayed through the display unit 135 and the sound unit 131 so that the gamer can prepare to play a game.

In step S215, the extruder 121 is automatically moved, and thereafter, when an up-and-down movement, a left-and-right movement or an up-and-down and left-and-right movements of the extruder 121, which is performed by operating movement keys, such as an up-and-down movement key, a left-and-right movement key, or an up-and-down and left-and-right movement keys of the key operating unit 133, is judged to be completed, the control unit 110 enables the extruder to be moved forward toward the direction Z in which the free gifts are arranged (S216~S217).

The key operation in step S216 may be basically performed in such a manner that only the left-and-right movement key is operated when the betting sums of money are distinguished by the layers as shown in FIG. 4, only the up-and-down movement key is operated when the betting sums of money are distinguished by the rows as shown in FIG. 6, and all of the up-and-down and left-and-right movement keys are operated when the betting zones are divided into the regions as shown in FIG. 8.

In addition to this, as shown in FIGS. 15 and 16, in a case where the movement prevention devices are provided in the gift showcase, even though the extruder is automatically moved to a corresponding layer, row, or region according to the betting sum of money, all of the up-and-down and left-and-right movement keys are operated so that the hitting point of a corresponding free gift can be changed.

In step S217, when it is judged that a state of the extruder 121 is not in a progress state, the control unit 110 continuously maintains a control state of the gift receiving unit 190 in the standby state, and when it is judged that the extruder 121 is moved onward, the control unit 110 enables the control state of the gift receiving unit 190 to be changed to the receiving state (S218).

In step S218, when the state of the gift receiving unit 190 is changed to the receiving state, the extruder is detected to be in a backward state (S219), the control unit 110, which has monitored the vibration detecting sensor 136 until now after the starting of a game, enables the state of the gift receiving unit to be changed to the storage state so that the free gifts received in the gift receiving unit 190 are kept in the storage unit 182 when it is judged that vibration is detected by the vibration detecting sensor 136 (S220), and at the same time, the door stopper 160 controls the door so that rotation of the door is interrupted, and an alarm is generated through the alarm unit 132, thereby enabling the game apparatus to be managed by a manager (S221).

In step S220, when it is judged that vibration is not detected by the vibration detecting sensor 136, the control unit 110 enables the state of the gift receiving unit 190 to the discharge state, and at the same time, a locked state of the stopper 160 is released so that the door is controlled to be rotated (S222).

In step S216, it is described that key operations of the key operating unit 133 are performed in such a manner that the extruder is operated only leftward and rightward or upward and downward when the free gifts are arranged in layers or rows, but as shown in FIGS. 15 to 17, in a case where the gift movement prevention devices are installed at the gift showcase, even though the extruder is moved in a corresponding layer or corresponding row, all of the up-and-down and the left-and-right movement keys can be operated.

As described above, the game apparatus for discharging free gifts enables the gamer to select various gifts according to betting sums of money and enjoy games because different free gifts are arranged according to the betting sums of money. Also, when the free gifts are intended to be illegally discharged during the game, the free gifts can be prevented from being discharged to the outside, and at the same time, an alarm is generated so that a person who carries out such an illegal action can be forced to stop the action by drawing the attention of a manager of the game apparatus who can prevent the free gifts from being discharged illegally.

Although the embodiments of the present invention have been described for illustrative purposes, those skilled in the art will appreciate that various modifications are possible without departing from the scope and spirit of the invention. Thus, it is intended that the present invention covers all such variations and modifications provided they come within the scope of the appended claims and their equivalents.

What is claimed is:

1. A game apparatus for discharging gifts, the game apparatus comprising:

a betting button unit that sets a sum of money among the sums of money;

a gift showcase comprised of two or more zones wherein each sum of money is matched to each zone where the gifts are displayed;

one or more lamps that distinguish the two or more zones;

an extruder operable within a plane located at an outside of the gift showcase;

a key operating unit to be controlled by a gamer to move the extruder within a corresponding zone matched to the set sums of money to push one of the gifts in the corresponding zone;

a control unit that activates the lamps of the zones matched with the sums of money, and controls the extruder to be moved to the corresponding zone automatically when the sum of money is set, the control unit controls the extruder according to the gamer's control of the key operating unit when the movement of the extruder to the corresponding zone is completed; and a discharge unit that discharges a gift dropped from the gift showcase, wherein the gift is dropped or not by the extruder's position to push the gift.

2. The game apparatus of claim 1, wherein the zones are arranged in layers or rows and have lamps distinguished by each layer or each row, and the control unit controls the lamps of a zone to blink by calculating a sum of money set by the betting button unit.

3. The game apparatus of claim 1, wherein the zones are comprised of two or more layers or two or more rows, and the lamps are positioned at an edge of each of the zones or at a center of each of the zones, and the control unit controls the lamps of a zone to be turned off by calculating the sum of money set through the betting button unit.

4. The game apparatus of claim 1, further comprising:

a storage unit that keeps the gift dropped from the gift showcase;

a gift receiving unit that is rotated so that the received gift turns to the discharge unit or the storage unit;

a vibration detecting sensor that detects whether or not vibration of the game apparatus occurs; and a control unit that controls a rotation direction of the gift receiving unit during a game according to whether or not the vibration is detected.

5. The game apparatus of claim 4, wherein the control unit enables the gift receiving unit to be rotated during the game so as to be in a state of receiving the gifts, controls the gift receiving unit so that a discharge direction of the gifts received in the gift receiving unit turns to the discharge unit when vibration is not detected by the vibration detecting sensor, and controls the gift receiving unit so that the discharge direction of the gifts turns to the storage unit when vibration is detected.

6. The game apparatus of claim 5, wherein a state of the gift receiving unit comprises a standby state in which the gift is controlled to turn to the storage unit; a receiving state in which the gift is controlled to be received during the game; and an ending state in which the received gift is controlled to turn to the discharge unit or the storage unit, wherein the control unit controls the gift receiving unit to be in the standby state before starting of the game, controls the gift receiving unit to be in the receiving state during the game, and controls the gift receiving unit to be in the ending state when finishing the game.

7. The game apparatus of claim 6, further comprising a gift input detecting sensor that detects whether or not the gift is input in the gift receiving unit, wherein the control unit controls a rotation direction of the gift receiving unit according to whether or not vibration is detected by the vibration detecting sensor when the gift is judged to be input in the gift receiving unit through the gift input detecting sensor.

8. The game apparatus of claim 7, wherein the control unit enables the gift receiving unit to be rotated so as to be in a state of receiving gifts during the game, and controls a discharge direction of the gifts received in the gift receiving unit to turn to the discharge unit when the gift is judged to be input in the gift receiving unit through the gift input detecting sensor, and vibration is not detected by the vibration detecting sensor.

* * * * *